US005162197A

United States Patent [19]

Aoki et al.

[11] Patent Number: 5,162,197

[45] Date of Patent: Nov. 10, 1992

[54] SILVER HALIDE PHOTOGRAPHIC MATERIAL

[75] Inventors: Kozo Aoki; Osamu Takahashi, both of Kanagawa, Japan

[73] Assignee: Fuji Photo Film Co., Ltd., Kanagawa, Japan

[21] Appl. No.: 317,270

[22] Filed: Feb. 28, 1989

[30] Foreign Application Priority Data

Feb. 29, 1988 [JP] Japan ..... 63-47270

[51] Int. Cl.[5] ..... G03C 7/34

[52] U.S. Cl. ..... 430/546; 430/552; 430/553

[58] Field of Search ..... 430/546, 552, 553

[56] References Cited

U.S. PATENT DOCUMENTS

| | | | |
|---|---|---|---|
| 2,895,826 | 7/1959 | Salminen et al. | 430/384 |
| 3,779,765 | 12/1973 | McCrossen et al. | 430/546 |
| 4,004,928 | 1/1977 | Miyazawa et al. | 430/546 |
| 4,327,173 | 4/1982 | Aoki et al. | 430/505 |
| 4,564,586 | 1/1986 | Aoki et al. | 430/505 |
| 4,613,564 | 9/1986 | Takada et al. | 430/553 |
| 4,767,697 | 8/1988 | Umemoto et al. | 430/546 |
| 4,857,449 | 8/1989 | Ogawa et al. | 430/546 |
| 4,863,840 | 9/1989 | Komorita et al. | 430/505 |
| 4,923,783 | 5/1990 | Kobayashi et al. | 430/377 |

FOREIGN PATENT DOCUMENTS

| | | | |
|---|---|---|---|
| 0289820 | 11/1988 | European Pat. Off. | 430/546 |

OTHER PUBLICATIONS

Webster's II New Riverside Dictionary, 1981, p. 92.
Hackh's Chemical Dictionary, 3rd Ed., 1944, p. 30.

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A silver halide photographic material comprising a support having thereon at least one hydrophilic colloid layer containing at least one cyan coupler forming coupler represented by the general formula (I) and at least one compound represented by the general formulas (II) or (III):

(I)

$L_1(COOR_4)_n$ (II)

$L_2(OCOR_5)_m$ (III)

wherein $R_1$ represents an aliphatic group, an aromatic group, a heterocyclic group, an aromatic amino group or a heterocyclic amino group; $R_2$, $R_4$ and $R_5$ each represents an aliphatic group, an aromatic group or a heterocyclic group; $R_3$ represents a hydrogen atom, a halogen atom, an aliphatic group, an aromatic group, an acylamino group, an aliphatic oxy group or an aromatic oxy group; $R_2$ and $R_3$ may combine with each other to form a 5-membered, 6-membered or 7-membered ring; Z represents a hydrogen atom or a group or atom which releases upon coupling with a developing agent; $L_1$ and $L_2$ each represents a divalent, trivalent or tetravalent aliphatic group; n and m each represents an integer from 2 to 4; each of $R_4$ and $R_5$ may be the same or different; and with the proviso that $L_2$ is not an unsubstituted cyclohexylene group when m is 2.

The silver halide photographic material provides color photographs in which color images have excellent fastness to light and heat and cyan coloration in white background areas is not observed with the lapse of time.

28 Claims, No Drawings

SILVER HALIDE PHOTOGRAPHIC MATERIAL

FIELD OF THE INVENTION

The present invention relates to a silver halide photographic material, and more particularly, to a silver halide photographic material which provides color images having improved preservability.

BACKGROUND OF THE INVENTION

When color development processing is carried out after a silver halide photographic material is exposed to light, an aromatic primary amine developing agent oxidized with silver halide reacts with a dye forming coupler to form a color image. In this process, color reproduction by a subtractive process is generally utilized. In accordance with this process, color images of yellow, magenta and cyan, which are complementary colors of blue, green and red, respectively, are formed in order to reproduce images of blue, green and red.

Phenol derivatives or naphthol derivatives have hitherto mainly been used as cyan color image forming couplers. However, the color images formed from conventional phenol or naphthol derivatives have preservability problems. For example, color images formed from 2-acylaminophenol cyan couplers as described in U.S. Pat. Nos. 2,367,531, 2,369,929, 2,423,730 and 3,772,002 generally have inferior heat fastness. Color images formed from 2,5-diacylaminophenol cyan couplers as described in U.S. Pat. Nos. 2,772,162 and 2,895,826 generally have inferior light fastness, along with those formed from 2-ureidophenol cyan couplers as described in U.S. Pat. Nos. 3,446,622 and 4,333,999. Further, color images formed from 1-hydroxy-2-naphthamide cyan couplers generally have inferior fastness to both light and heat (particularly humidity and heat).

On the other hand, cyan couplers represented by the general formula (I) described below reduce the inherent sensitivity of the photographic emulsion, that is, they are apt to cause desensitization. This leads to difficulty in the design for photographic light-sensitive materials. Moreover, among the cyan couplers represented by the general formula (I), those having a high color forming property and those having the general formula (I) wherein $R_2$ and $R_3$ combine with each other to form a ring are particularly disadvantageous in that unexposed white background areas of the photographic materials containing these couplers tends to color cyan with the lapse of time.

SUMMARY OF THE INVENTION

A an object of the present invention to provide a silver halide photographic material which forms color images having excellent fastness to light and heat.

Another object of the present invention is to provide a silver halide photographic material which provides a color photograph in which unexposed white background areas do not become colored cyan with the lapse of time.

A further object of the present invention is to provide a silver halide photographic material produced with a silver halide photographic emulsion which looses little sensitivity when stored for prolorged periods between preparation of the emulsion and the coating thereof.

Other objects of the present invention are apparent from the following detailed description and examples.

The above described objects of the present invention are accomplished with a silver halide photographic material comprising a support having thereon at least one hydrophilic colloid layer containing at least one cyan dye forming coupler represented by the general formula (I) and at least one compound represented by the general formulae (II) or (III):

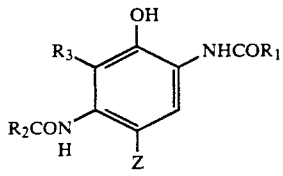

(I)

$$L_1(COOR_4)_n \quad \text{(II)}$$

$$L_2(OCOR_5)_m \quad \text{(III)}$$

wherein $R_1$ represents an aliphatic group, an aromatic group, a heterocyclic group, an aromatic amino group or a heterocyclic amino group; $R_2$, $R_4$ and $R_5$ each represents an aliphatic group, an aromatic group or a heterocyclic group; $R_3$ represents a hydrogen atom, a halogen atom, an aliphatic group, an aromatic group, an acylamino group, an aliphatic oxy group or an aromatic oxy group; $R_2$ and $R_3$ may combine with each other to form a 5-membered, 6-membered or 7-membered ring; Z represents a hydrogen atom or a group or atom which releases upon coupling with the oxidation product of an aromatic primary amine developing agent; $L_1$ and $L_2$ each represents a divalent, trivalent or tetravalent aliphatic group; n and m each represents an integer from 2 to 4; each of $R_4$ and $R_5$ may be the same or different; and with the proviso that $L_2$ is not an unsubstituted cyclohexylene group when m is 2.

DETAILED DESCRIPTION OF THE INVENTION $R_1$, $R_2$, $R_3$, $R_4$, $R_5$, $L_1$, $L_2$ and Z in the above general formulae (I), (II) and (III) are described in detail below.

In the present invention, the term "aliphatic group" means a straight chain or branched chain aliphatic hydrocarbon group and includes a saturated or unsaturated aliphatic group, for example an alkyl group, an alkenyl group, and an alkynyl group. Representative examples of aliphatic groups include a methyl group, an ethyl group, a butyl group, a dodecyl group, an octadecyl group, an eicosanyl group, an isopropyl group, a tert-butyl group, a tertoctyl group, a tert-dodecyl group, an allyl group, a vinyl group, a 2-hexadecenyl group, and a propargyl group. The term "cyclic group" as used herein means a cyclic hydrocarbon group. Representative examples of a cyclic groups include a cyclohexyl group and a cyclopentyl group.

$R_1$ in the general formula (I) represents an aliphatic group preferably having from 1 to 36 carbon atoms a cyclic alkyl group preferably having from 3–36 carbon atoms (for example, cyclohexyl and cyclopentyl), an aromatic group preferably having from 6 to 36 carbon atoms (for example, phenyl, or naphthyl), a heterocyclic group (for example, 3-pyridyl, or 2-furyl), or an aromatic or heterocyclic amino group (for example, anilino, naphthylamino, 2-benzothiazolylamino, or 2-pyridylamino). These groups can be substituted with a substituent selected from an alkyl group, an aryl group, a heterocyclic group, an alkoxy group (for example, methoxy, or 2-methoxyethoxy), an aryloxy group (for example, 2,4-di-tert-amylphenoxy, 2-chlorophenoxy, or 4-cyanophenoxy), an alkenyloxy group (for example, 2-propenyloxy), an acyl group (for example, acetyl, or benzoyl), an ester group (for example, butoxycarbonyl, phenoxycarbonyl, acetoxy, benzoyloxy, butoxysulfonyl, or toluenesulfonyloxy), an amido group (for example, acetylamino, ethylcarbamoyl, dimethylcarbamoyl, methanesulfonamido, or butylsulfamoyl), a sulfamido group (for example, dipropylsulfamoylamino), an imido group (for example, succinimido, or hydantoinyl), a ureido group (for example, phenylureido, or dimethylureido), an aliphatic or aromatic sulfonyl group (for example, methanesulfonyl, or phenylsulfonyl), an aliphatic or aromatic thio group (for example, ethylthio, or phenylthio), a hydroxy group, a cyano group, a carboxy group, a nitro group, a sulfo group, and a halogen atom.

$R_2$ in the general formula (I), $R_4$ in the general formula (II) and $R_5$ in the general formula (III) each represents an aliphatic group preferably having from 1 to 36 carbon atoms a cyclic alkyl group, an aromatic group preferably having from 6 to 36 carbon atoms or a heterocyclic group. Although these groups may have a substituent described for $R_1$ above, $R_4$ and $R_5$ can not be substituted with a cyclic ether group such as an epoxy group.

$R_3$ in the general formula (I) represents a hydrogen atom, a halogen atom (for example, fluorine, chlorine, or bromine), an aliphatic group, an aromatic group, an acylamino group (for example, acetylamino, or benzoylamino), an aliphatic oxy group (for example, methoxy, or butoxy), or an aromatic oxy group (for example, phenoxy). Among them, those capable of being substituted may have a substituent described for $R_1$ above. The aliphatic group of $R_3$ is preferably a lower alkyl group.

It is preferred that the carbon number of $R_1$, $R_2$, and $R_3$ or a combination thereof is sufficient to make the coupler of the invention diffusion-resistant in a photographic layer.

$L_1$ and $L_2$ in the general formula (II) and (III) each represents a divalent, trivaleat or tetravalent aliphatic group and includes groups which are formed by adding connecting position(s) to the monovalent aliphatic group described above. Representative examples of the aliphatic group include an alkylidene group (for example, methylene, ethylidene, or cyclohexylidene), an alkylene group (for example, ethylene, trimethylene, hexamethylene, undecamethylene, 1,2-cyclohexylene, 1,4-cyclohexylene, or 3,8-tricyclo[5,2,1, $O^{2,6}$]decylene), and an alkenylene group (for example, vinylene, propenylene, 4-cyclohexen-1,2-yl, or 2-pentenylene), when n or m is 2; an alkanetriyl group (for example, 1,2,3-propanetriyl, 2-methylene-1,3-propanediyl, or 1,5,8-octanetriyl), and an alkenetriyl group (for example, 1,2,3-propenetriyl, or 2-propene-1,2,4-triyl), when n or m is 3; and an alkanetetrayl group (for example, 1,2,3,4-butanetetrayl, 1,3-propanediyl-2-ylidene, or 2,2-bismethylene-1,3-propanediyl), and an alkenetetrayl group (for example, 3-octene-1,3,5,8-tetrayl), when n or m is 4.

Z in the general formula (I) represents a hydrogen atom or a group which releases upon coupling. Examples of groups which release upon coupling include a halogen atom (for example, fluorine, chlorine, or bromine), an alkoxy group (for example, ethoxy, dodecyloxy, methoxyethylcarbamoylmethoxy, carboxypropyloxy, or methylsulfonylethoxy), an aryloxy group (for example, 4-chlorophenoxy, 4-methoxyphenoxy, or 4-carboxyphenoxy), an acyloxy group (for example, acetoxy, tetradecanoyloxy, or benzoyloxy), a sulfonyloxy group (for example, methanesulfonyloxy, or toluenesulfonyloxy), an amido group (for example, dichloroacetylamino, heptafluorobutyrylamino, methanesulfonylamino, or toluenesulfonylamino), an alkoxycarbonyloxy group (for example, ethoxycarbonyloxy, or benzyloxycarbonyloxy), an aryloxycarbonyloxy group (for example, phenoxycarbonyloxy), an aliphatic or aromatic thio group (for example, ethylthio, phenylthio, or tetrazolylthio), an imido group (for example, a succinimido, or hydantoinyl), and an aromatic azo group (for example, phenylazo). These groups may contain a photographically useful group.

$R_1$ in general formula (I) may be a divalent group to form a bis coupler or a polymer coupler.

In the general formula (I), Z is preferably a hydrogen atom, a halogen atom, an alkoxy group, or an aryloxy group.

In the general formula (I), $R_2$ and $R_3$ preferably combine with each other to form a ring, more preferably a 5-membered or 6-membered ring and most preferably a 5-membered ring. When $R_2$ and $R_3$ combine with each other to form a ring, $R_1$ is preferably a phenyl group which may be substituted.

In the general formula (I), $R_1$ is preferably an alkyl group substituted with a halogen atom, an aromatic group which may be substituted or a substituted aromatic amino group.

In the general formula (II) or (III), the total number of carbon atoms included in $R_4$ and $L_1$ or $R_5$ and $L_2$ is preferably from 12 to 60, more preferably from 16 to 36 in practical use.

In the general formula (II) or (III), n or m is preferably 2 or 3.

Of the compounds represented by the general formula (II) or (III), those represented by the general formula (II) are preferred in the present invention.

The hydrophilic colloid layer containing the cyan coupler represented by general formula (I) and the compound represented by general formula (II) or (III) is preferably a silver halide emulsion layer and a red-sensitive silver halide emulsion layer is particularly preferred.

The amount of the compound represented by the general formula (II) or (III) to be added to the hydrophilic colloid layer is in the range of from 0.1 to 10 parts by weight based on the coupler represented by the general formula (I).

The coupler represented by the general formula (I) is disclosed, for example, in U.S. Pat. Nos. 2,895,826, 4,557,999, 4,565,777, 4,613,564, 4,327,173, 4,564,586, and 4,430,423.

Specific examples of the cyan dye forming couplers represented by the general formula (I) according to the present invention are set forth below, but the present invention should not be construed as being limited thereto.

(I-1)
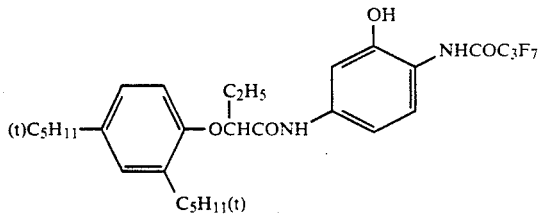
(I-2)
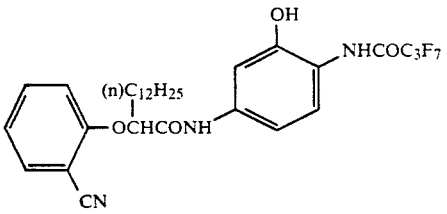
(I-3)
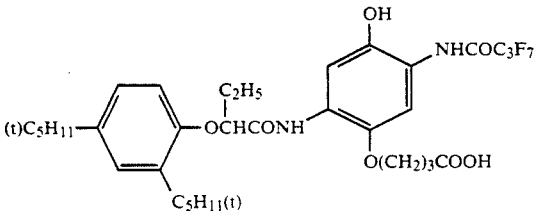
(I-4)
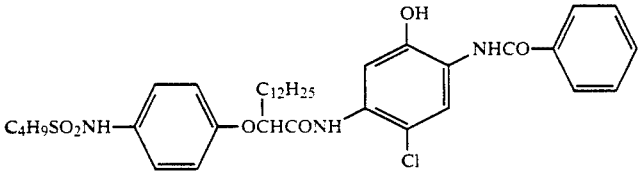
(I-5)
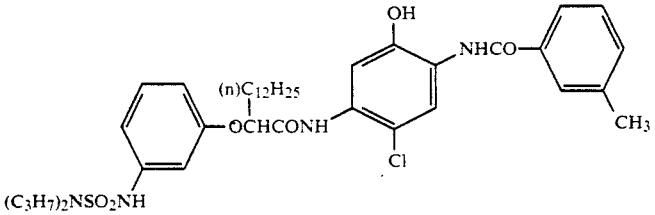
(I-6)
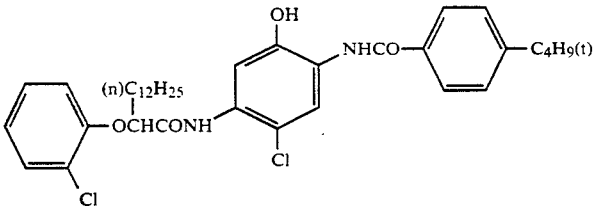
(I-7)
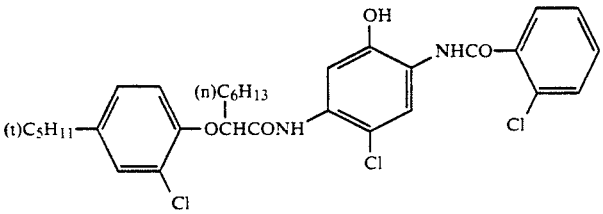

-continued
(I-8)
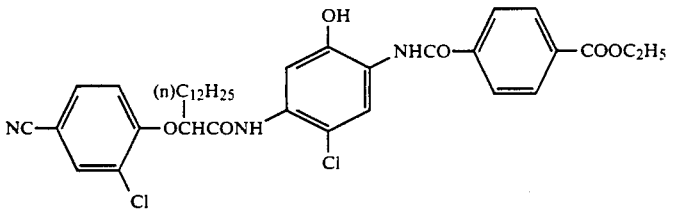
(I-9)
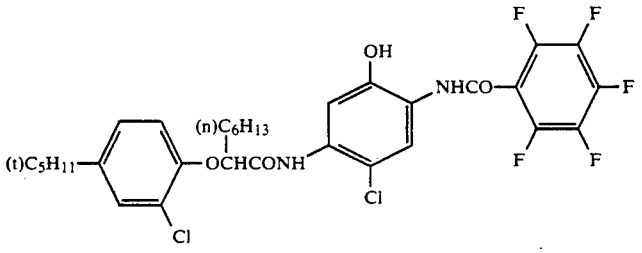
(I-10)
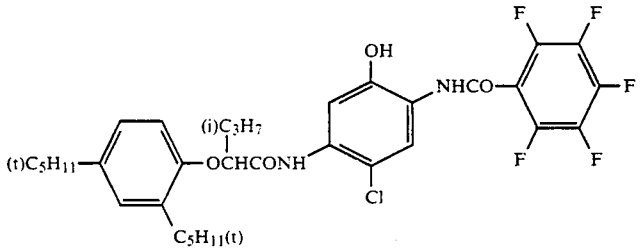
(I-11)
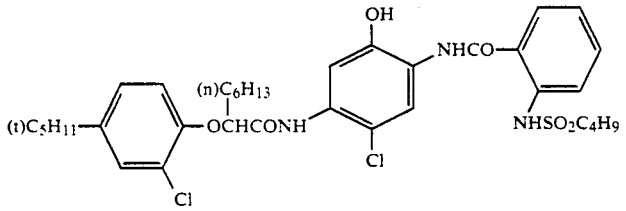
(I-12)
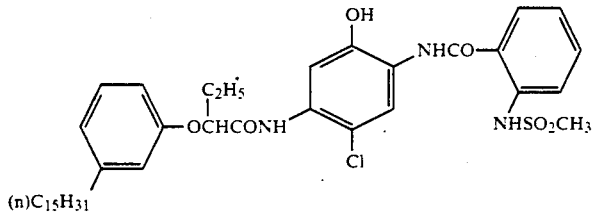
(I-13)
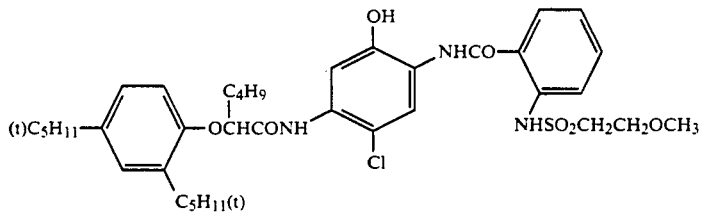
(I-14)
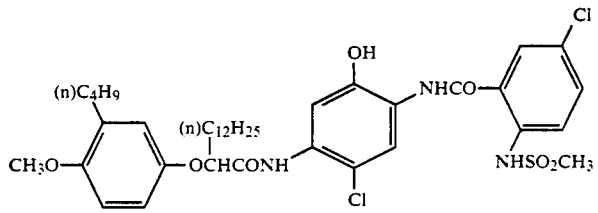

-continued
(I-15)
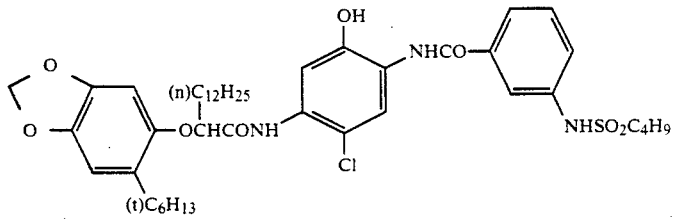
(I-16)
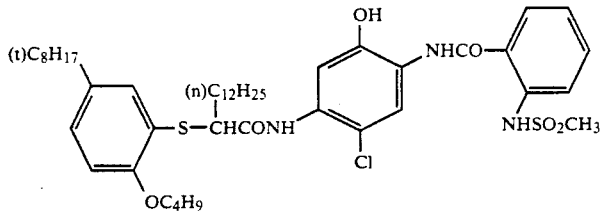
(I-17)
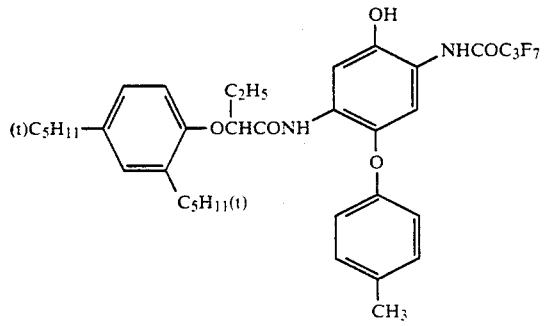
(I-18)
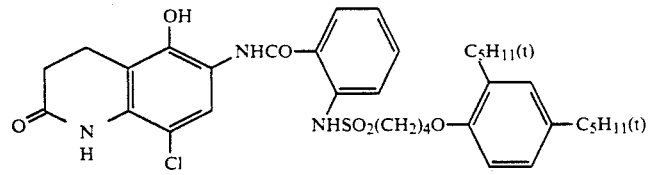
(I-19)
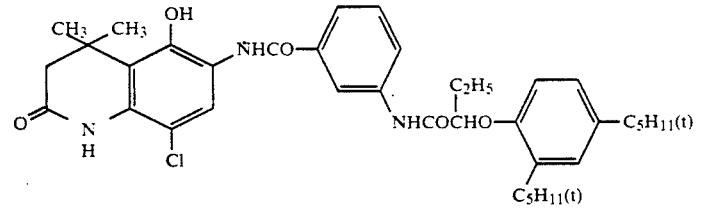
(I-20)
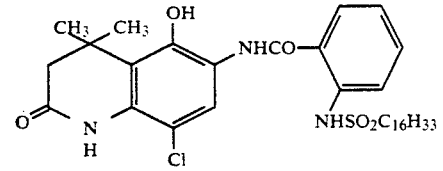
(I-21)
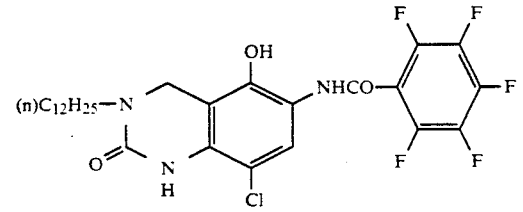

-continued
(I-22)
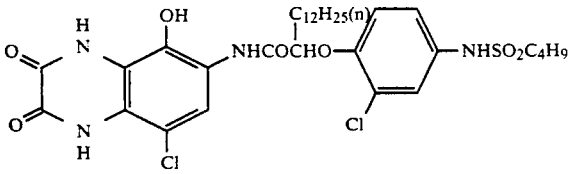
(I-23)
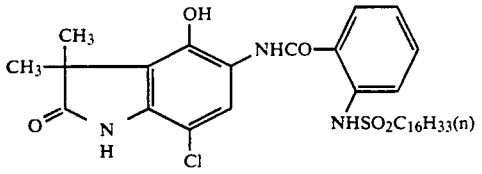
(I-24)
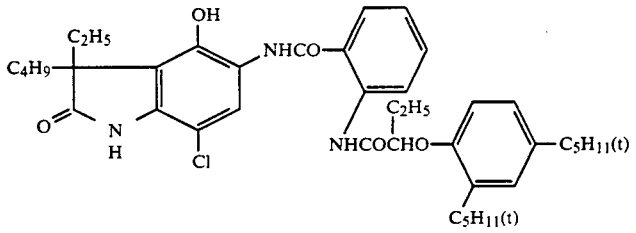
(I-25)
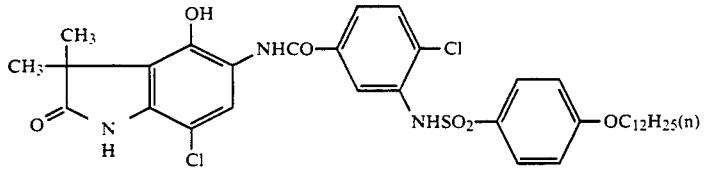
(I-26)
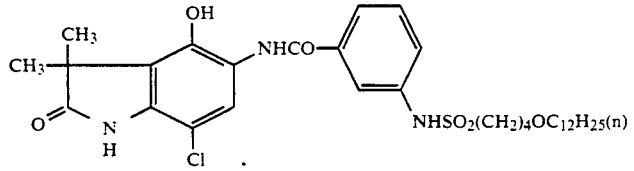
(I-27)
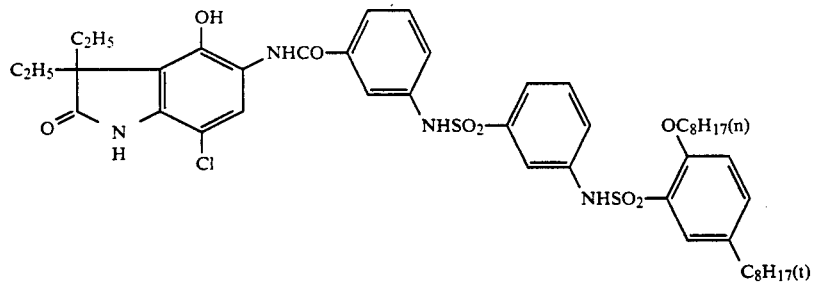
(I-28)
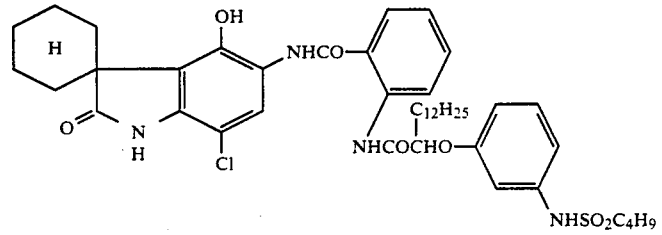

-continued
(I-29)
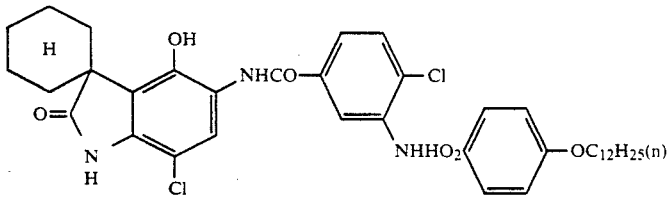
(I-30)
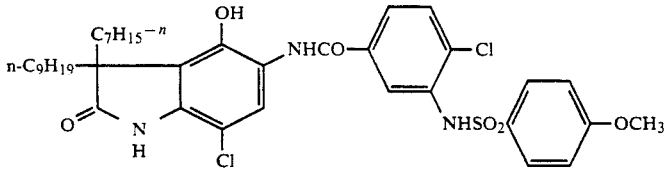
(I-31)
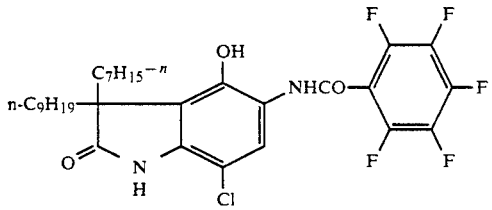
(I-32)
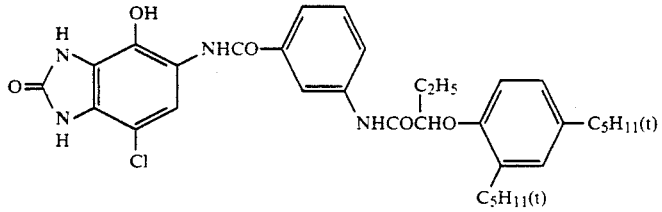
(I-33)
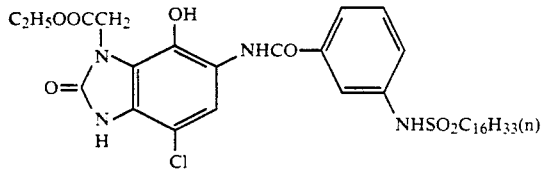
(I-34)
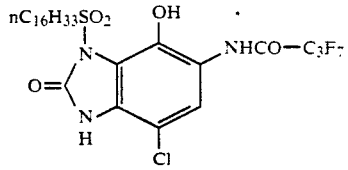
(I-35)
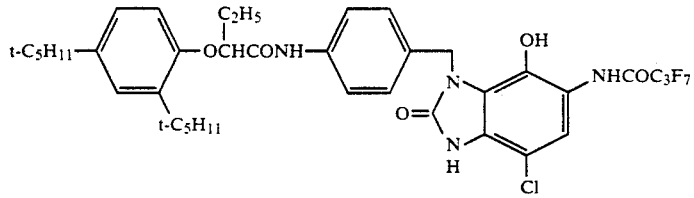
(I-36)
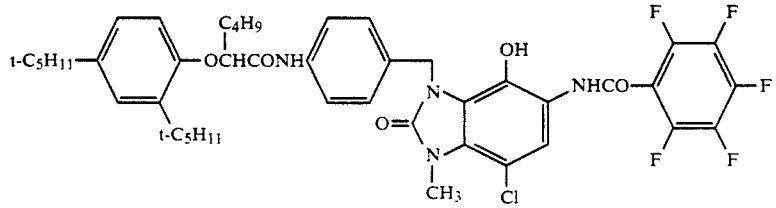

-continued
(I-37)
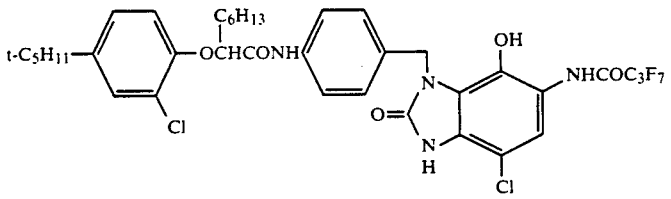
(I-38)
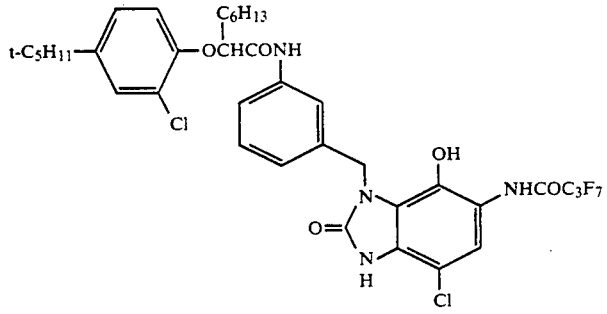
(I-39)
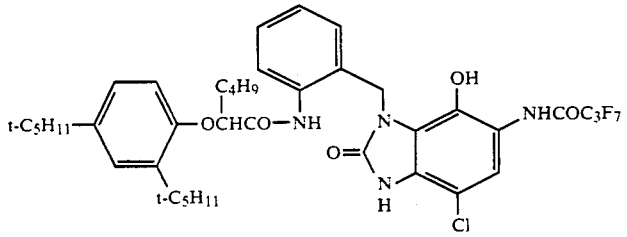
(I-40)
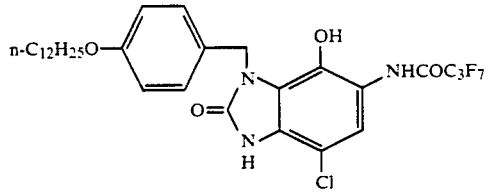
(I-41)
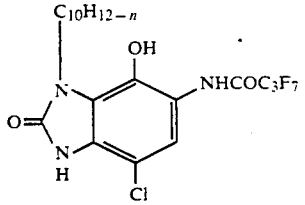
(I-42)
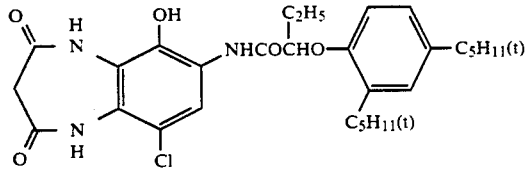
(I-43)
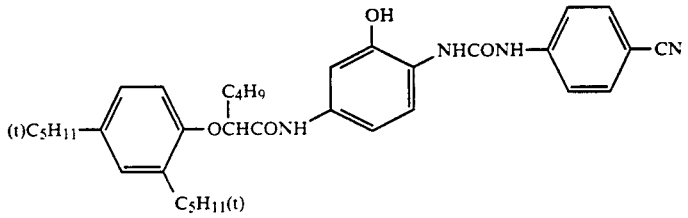

-continued
(I-44)
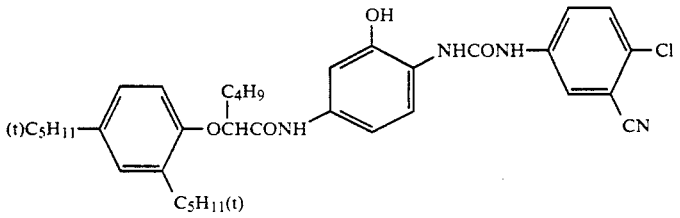
(I-45)
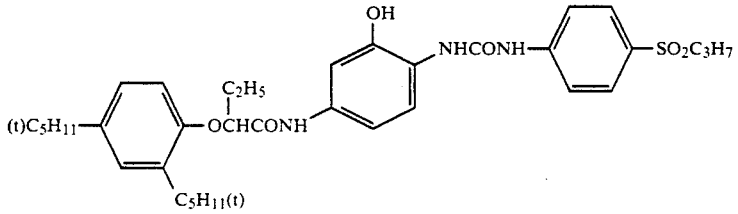
(I-46)
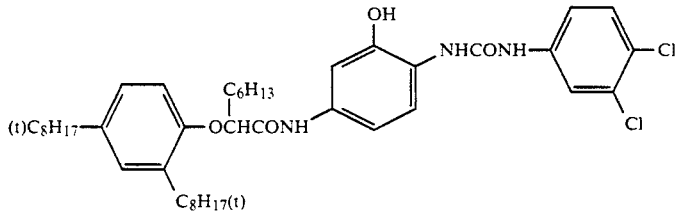
(I-47)
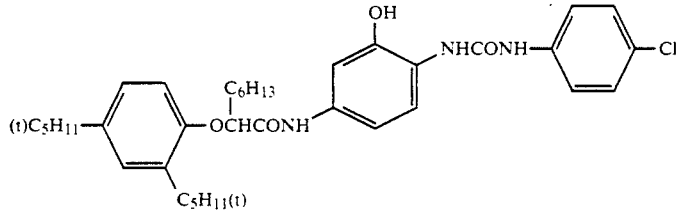
(I-48)
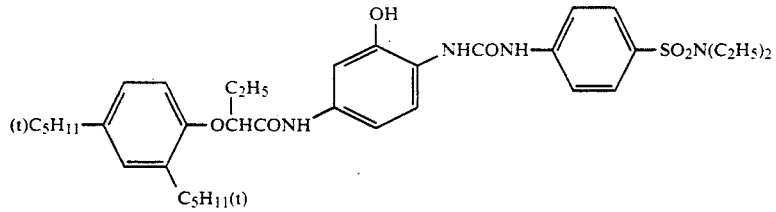
(I-49)
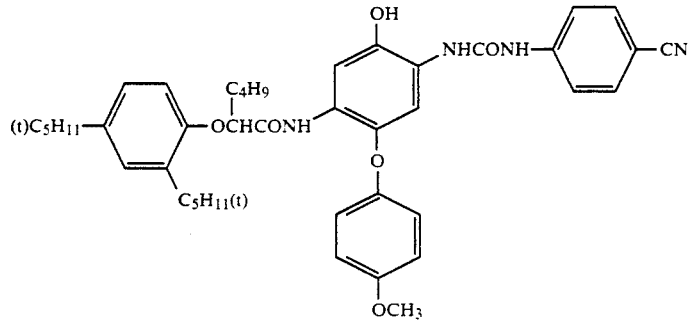

-continued
(I-50)
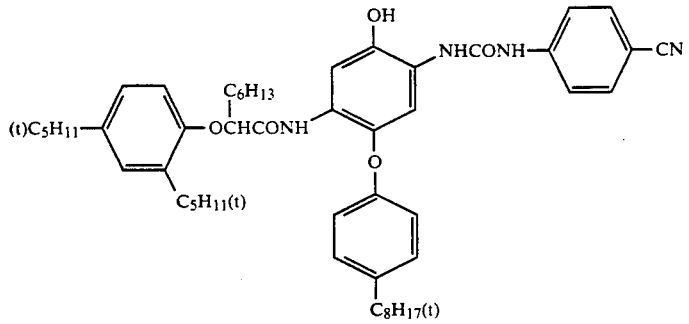
(I-51)
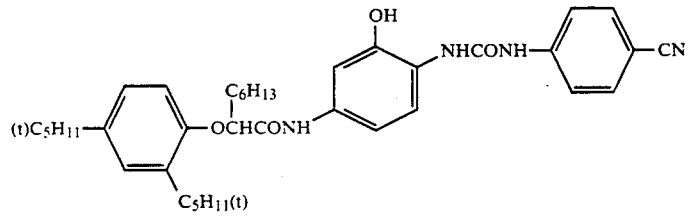
(I-52)
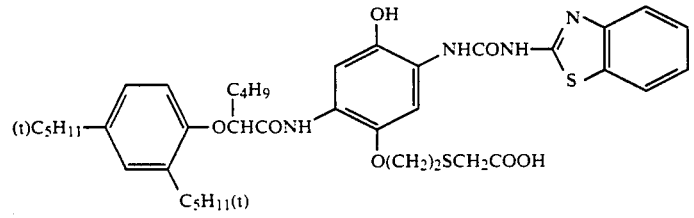
(I-53)
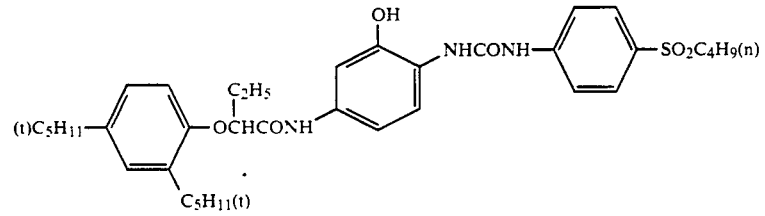
(I-54)
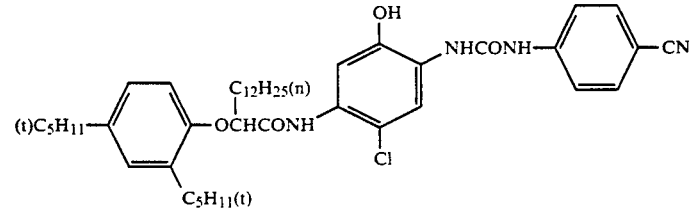
(I-55)
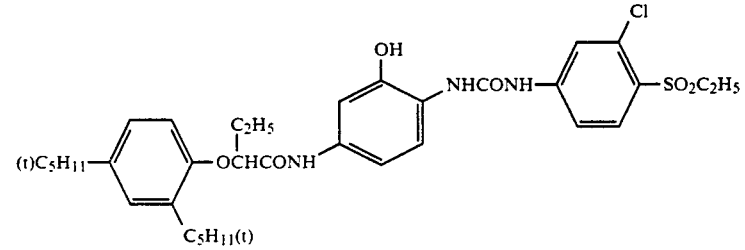

-continued
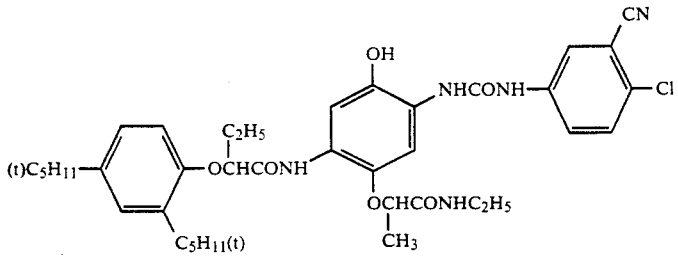
(I-56)
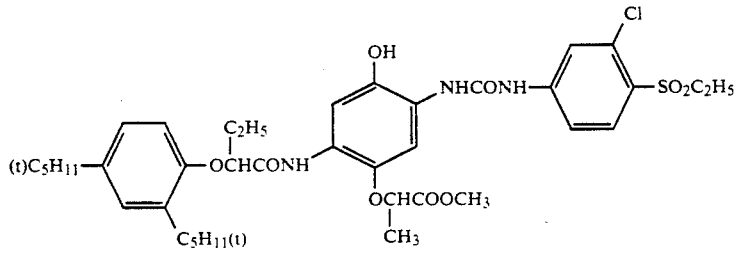
(I-57)
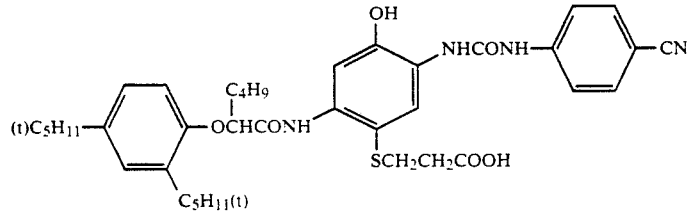
(I-58)
Specific examples of the compounds represented by the general formula (II) or (III) are set forth below, but the present invention should not be construed as being limited thereto.
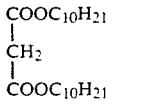
II-1
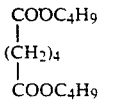
II-2
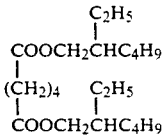
II-3
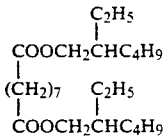
II-4
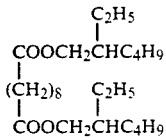
II-5
-continued
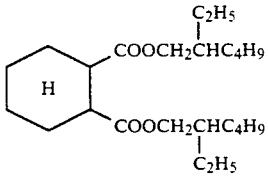
II-6
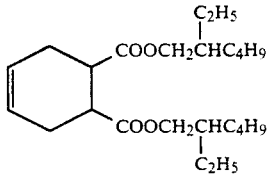
II-7
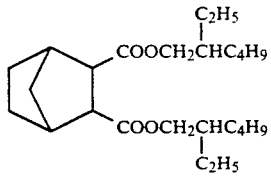
II-8
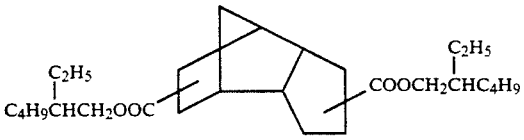
II-9
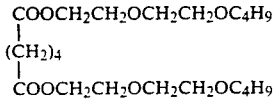
II-10

-continued
II-11
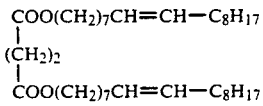
II-12
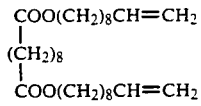
II-13
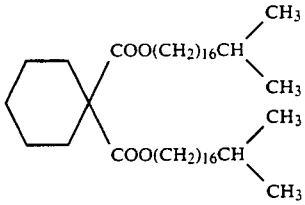
II-14
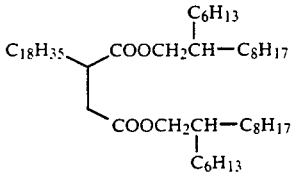
II-15
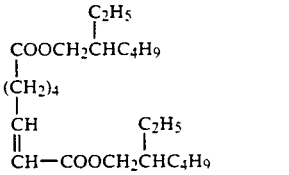
II-16
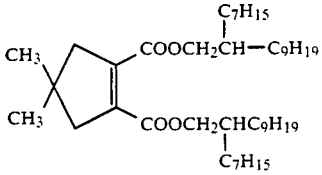
II-17
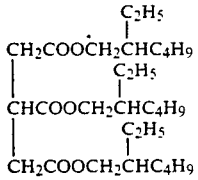
II-18
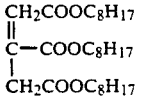
II-19
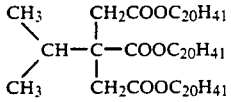
II-20
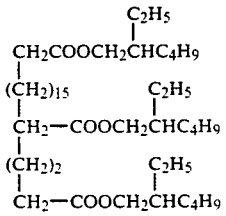
-continued
II-21
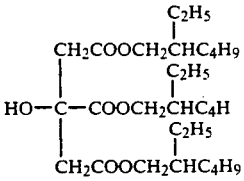
II-22
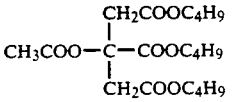
II-23
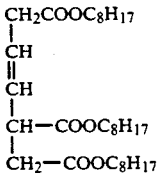
II-24
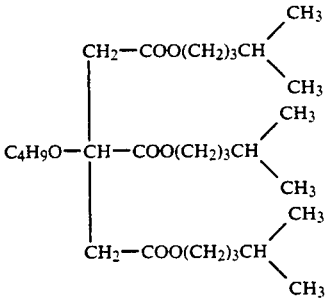
II-25
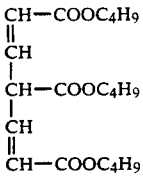
II-26
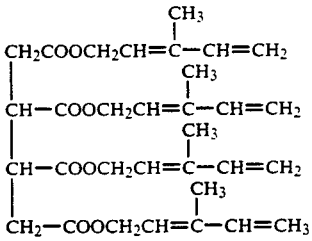
II-27
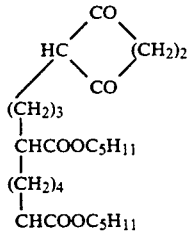
II-28
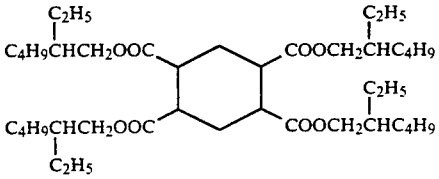

-continued

III-1

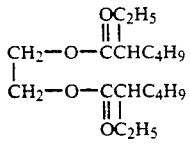

III-2

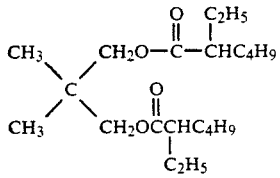

III-3

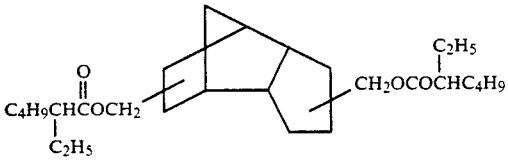

III-4

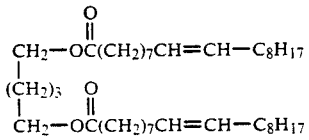

III-5

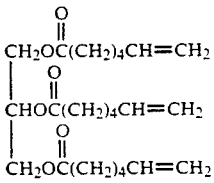

III-6

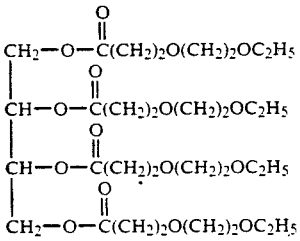

III-7

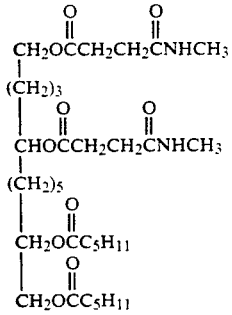

III-8

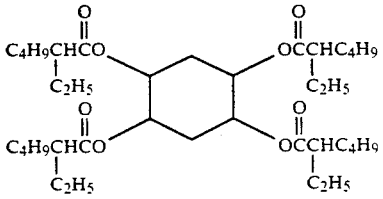

-continued

III-9

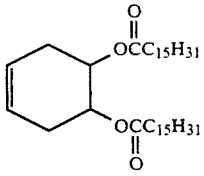

III-10

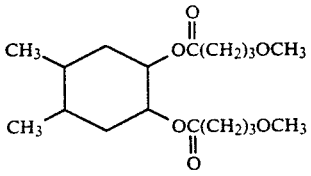

III-11

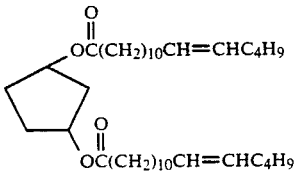

III-12

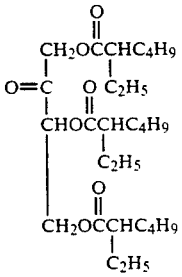

III-13

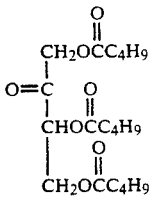

Koichi Murai, *Kasozai-Sono Riron To Oyo* ("The Plasticizer-its theory and applications"), Saiwai Shobo Co., Ltd. page 444 (1973) can be referenced to synthesize the compounds represented by the general formula (II) and (III). In addition, the compound II-5 is on sale as tradename "DOS" by Daihachi Kagaku Co., Ltd. or Shinnippon Rika Co., Ltd.

In accordance with the present invention, the suprising and superior effect thus attained is that the desensitization of the silver halide caused by the cyan coupler and cyan coloration in white background areas with the lapse of time are prevented while the high color forming property of the cyan coupler represented by the general formula (I) is maintained.

In order to sufficiently exhibit the effect of the present invention, the compound represented by general formula (II) or (III) is employed preferably in a range of from 0.1 to 10 parts by weight, more preferably from 0.2 to 2 parts by weight based on the quantity of cyan coupler represented by the general formula (I) used.

Two are more kinds of the couplers represented by the general formula (I) can be used in combination thereof. A known cyan coupler can be used together with the cyan coupler represented by the general formula (I) in the same layer or in other layers. Cyan couplers which are preferably used in combination with the coupler according to the present invention are represented by the following general formulas (C-I) or (C-II):

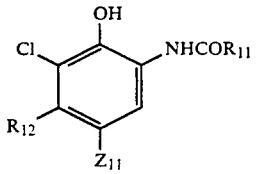

(C-I)

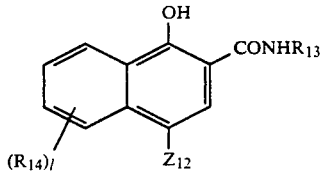

(C-II)

wherein $R_{11}$ and $R_{13}$ each represents an aliphatic group, an aromatic group or a heterocyclic group; $R_{12}$ represents an alkyl group having from 1 to 20 carbon atoms; $R_{14}$ represents a group capable of substituting on the naphthalene ring; $Z_{11}$ and $Z_{12}$ each represents a hydrogen atom or a group or atom which releases upon a coupling reaction with a developing agent; and l represents 0, 1 or 2.

In the general formula (C-I), $R_{12}$ is preferably an alkyl group having from 2 to 4 carbon atoms.

In the general formula (C-II), $R_{14}$ preferably represents $R_{15}NH$- wherein $R_{15}$ represents an acyl group, a sulfonyl group, an aliphatic oxy group or an aromatic oxy group.

The amount of the cyan couplers represented by the general formula (C-I) or (C-II) to be added is $1\times10^{-3}$ to 1 mol, preferably $1\times10^{-1}$ to $5\times10^{-1}$ mol per mol of silver halide.

The coupler represented by formula (C-I) is disclosed, for example, in U.S. Pat. Nos. 3,772,002, 4,564,590, 2,369,929, 4,518,687, and 4,511,647. The coupler represented by formula (C-II) is disclosed, for example, in JP-A-60-237448, JP-A-61-145557, and JP-A-61-153640.

Representative examples of the cyan couplers represented by the general formula (C-I) or (C-II) are set forth below.

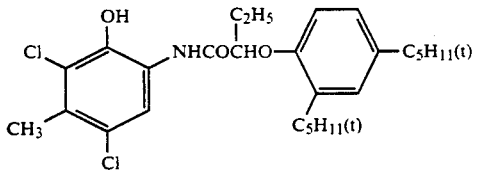

(C-1)

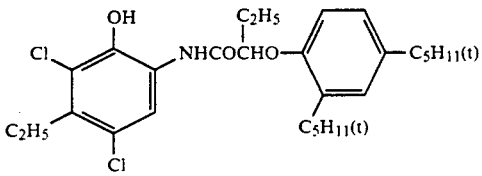

(C-2)

-continued

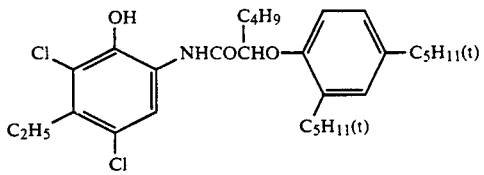

(C-3)

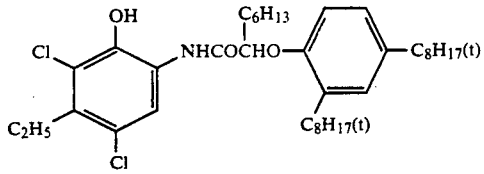

(C-4)

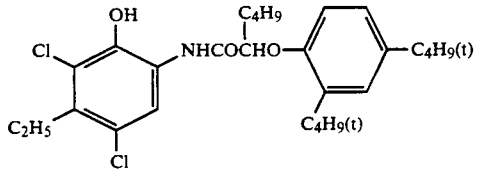

(C-5)

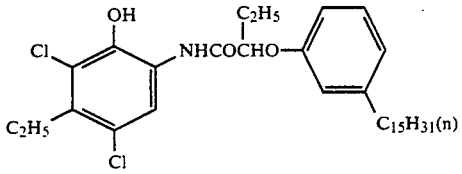

(C-6)

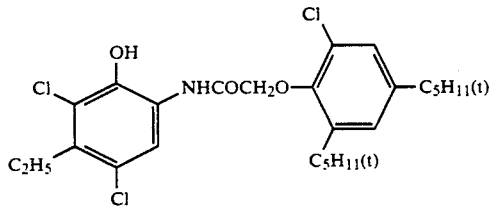

(C-7)

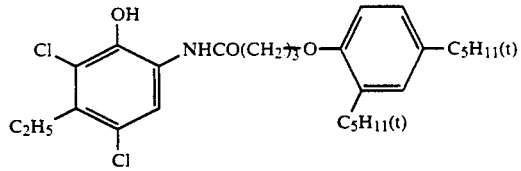

(C-8)

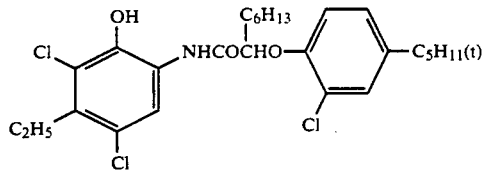

(C-9)

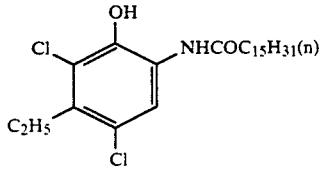

(C-10)

-continued (C-11)

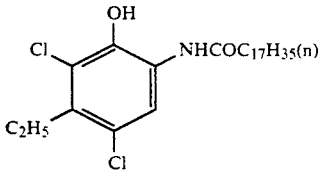

(C-12)

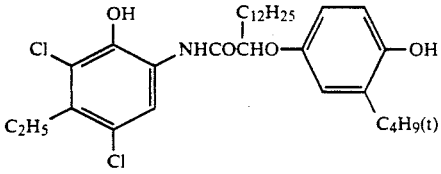

(C-13)

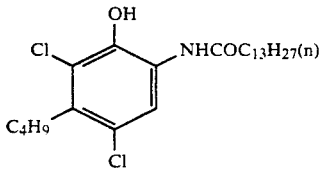

(C-14)

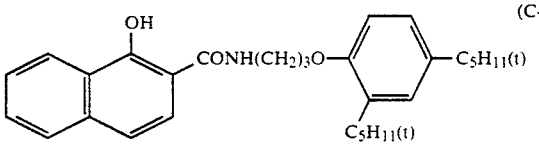

(C-15)

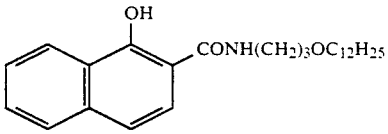

(C-16)

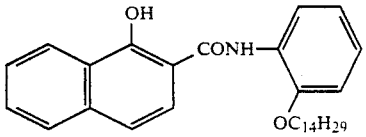

(C-17)

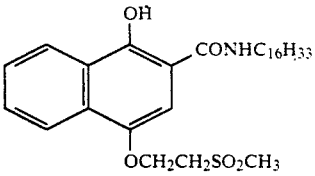

(C-18)

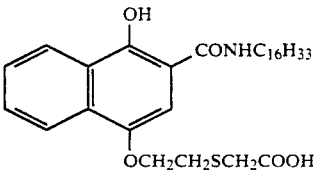

(C-19)

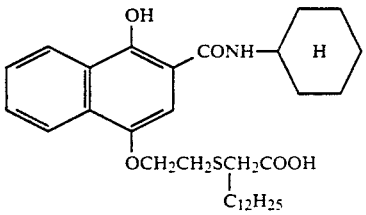

-continued (C-20)

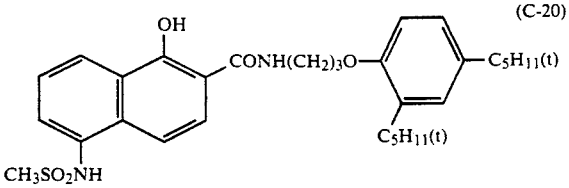

(C-21)

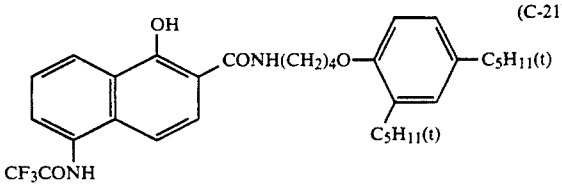

(C-22)

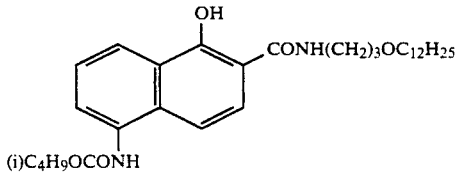

(C-23)

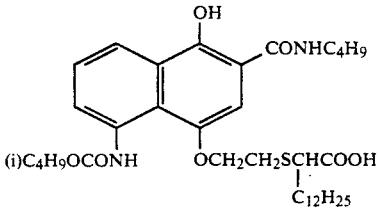

(C-24)

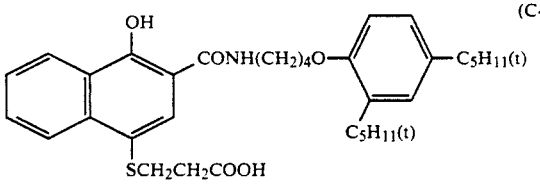

(C-25)

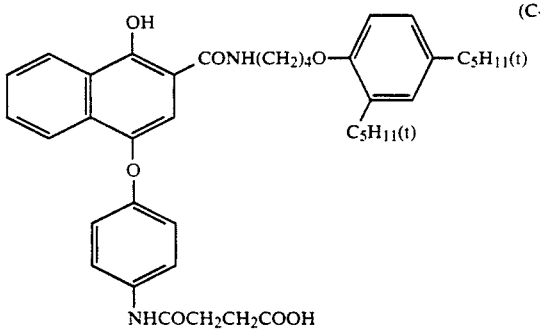

The couplers for use in the present invention can be introduced into a silver halide emulsion layer by known methods. Various additives, for example, a coupler solvent, an ultraviolet light absorbing agent, a protective colloid, a binder, an antifogging agent, a color mixing preventing agent, a color fading preventing agent, a sensitizing dye, a dye, a fluorescent brightening agent, etc.; methods for forming a silver halide photographic material, (for example, a method for preparation of photographic emulsion, a method for introduction of coupler, a support, a layer composition of each light-sensitive layer, etc.); and methods of photographic processing, the substances and methods as described in

*Research Disclosure*, No. 17643, Industrial Opportunies Ltd., UK (December, 1978), JP-A-56-65134 and JP-A-56-104333 (the term "JP-A" as used herein means an "unexamined published Japanese patent application") or the literature cited therein can be employed.

The amount of the coupler of general formula (I) added according to the present invention is usually from $1\times10^{-3}$ mol to 1.0 mol, preferably from 0.1 mol to 0.5 mol per mol of silver halide comprising a light-sensitive layer.

In the present invention, known magenta couplers and yellow couplers can be introduced into a color photographic light-sensitive material in combination with at least one of the cyan couplers represented by the general formula (I).

The amount of the magenta coupler or the yellow coupler to be added is the same ranges as the cyan coupler.

Yellow couplers preferably used in the present invention include acylacetamido derivatives such as benzoylacetanilides and pivaloylacetanilides.

Among them, those represented by the general formulae (Y-1) or (Y-2) shown below are particularly preferred as yellow couplers.

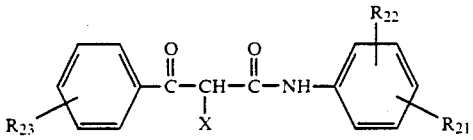

(Y-1)

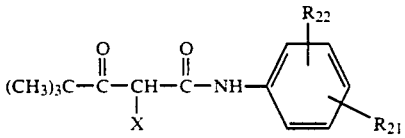

(Y-2)

wherein X represents a hydrogen atom or a group which releases upon coupling; $R_{21}$ represents a diffusion resistant group having from 8 to 32 carbon atoms; $R_{22}$ represents a hydrogen atom, at least one halogen atom, lower alkyl group, lower alkoxy group or diffusion resistant group having from 8 to 32 carbon atoms; and $R_{23}$ represents a hydrogen atom or a substituent, such that when two or more $R_{23}$ groups are present, they may be the same or different.

The pivaloylacetanilide type yellow couplers are described in detail in U.S. Pat. No. 4,622,287, column 3, line 15 to column 8, line 39 and U.S. Pat. No. 4,623,616, column 14, line 50 to column 19, line 41.

The benzoylacetanilide type yellow couplers are described in detail in U.S. Pat. Nos. 3,408,194, 3,933,501, 4,046,575, 4,133,958 and 4,401,752.

More specifically, as pivaloylacetanilide type yellow couplers, Compounds (Y-1) to (Y-39) as described in the above mentioned U.S. Pat. No. 4,622,287, column 37 to column 54 are suitable. Of the compounds, Compounds (Y-1), (Y-4), (Y-6), (Y-7), (Y-15), (Y-21), (Y-22), (Y-23), (Y-26), (Y-35), (Y-36), (Y-37), (Y-38) and (Y-39) are preferred.

Further, Compounds (Y-1) to (Y-33) as described in the above mentioned U.s. Patent 4,623,616, column 19 to column 24 are suitable. Of these compounds, Compounds (Y-2), (Y-7), (Y-8), (Y-12), (Y-20), (Y-21), (Y-23) and (Y-29) are preferred.

Moreover, Compound (34) as described in U.S. Pat. No. 3,408,194, column 6; Compounds (16) and (19) as described in U.S. Pat. No. 3,933,501, column 8; Compound (9) as described in U.S. Pat. No. 4,046,575, column 7 to column 8; Compound (1) as described in U.S. Pat. No. 4,133,958, column 5 to column 6; Compound (1) as described in U.S. Pat. No. 4,401,752, column 5; and Compounds a) to g) described below are also preferred.

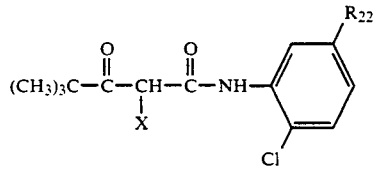

| Compound | $R_{22}$ | X |
|---|---|---|
| a | $-COOCH(CH_3)COOC_{12}H_{25}$ | 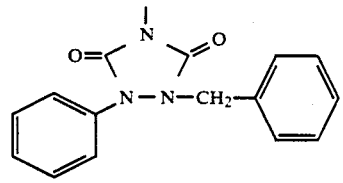 |
| b | $-COOCH(C_4H_9)COOC_{12}H_{25}$ | 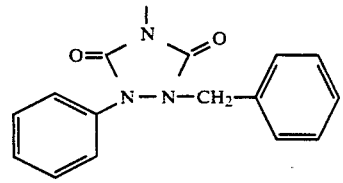 |

-continued

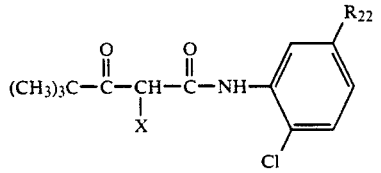

| Compound | $R_{22}$ | X |
|---|---|---|
| c | 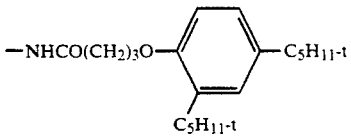 | 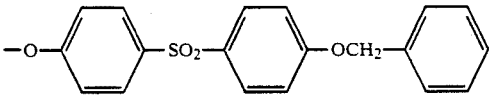 |
| d | 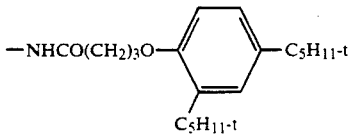 | 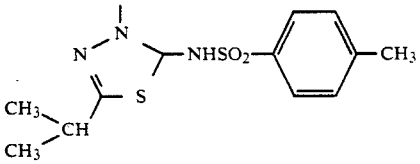 |
| e | 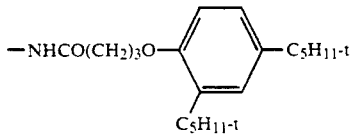 | 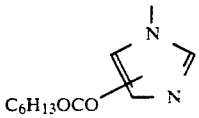 |
| f | $-NHSO_2C_{12}H_{25}$ | 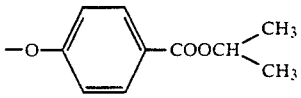 |
| g | $-NHSO_2C_{16}H_{33}$ | 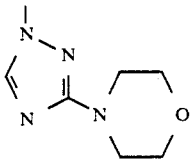 |

Among the couplers described above, those having a nitrogen atom as a releasing atom are particularly preferred.

Magenta couplers for use in the present invention include oil protected indazolone type couplers and cyanoacetyl type couplers, preferably 5-pyrazolone type couplers and pyrazoloazole type couplers such as pyrazolotriazoles are exemplified. Of 5-pyrazolone type couplers, those substituted with an arylamino group or an acylamino group at the 3-position thereof are preferred in view of hue and color density of the dyes formed. Typical examples thereof are described, for example, in U.S. Pat. Nos. 2,311,082, 2,343,703, 2,600,788, 2,908,573, 3,062,563, 3,152,896, and 3,936,015. Two-equivalent 5-pyrazolone type couplers containing nitrogen atom-releasing groups as described in U.S. Pat. No. 4,310,619 and arylthio groups as described in U.S. Pat. No. 4,351,897, as releasing groups are preferred. Further, 5-pyrazolone type couplers having a ballast group as described in European Patent 73,636 are advantageous because they provide high color density.

Examples of pyrazoloazole type couplers include pyrazolobenzimidazoles as described in U.S. Pat. No. 3,369,879, and preferably pyrazolo[5,1-c][1,2,4]triazoles as described in U.S. Pat. No. 3,725,067, pyrazolotetrazoles as described in *Research Disclosure*, No. 24220 (June, 1984), and pyrazolopyrazoles as described in *Research Disclosure*, No. 24230 (June, 1984). The above described couplers may be in the form of polymer couplers.

These compounds are specifically represented by the following general formula (M-1), (M-2) or (M-3):

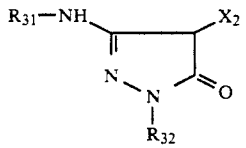

(M-1)

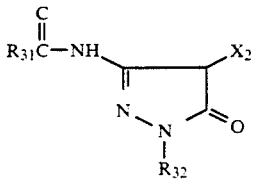

(M-2)

-continued

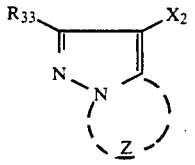

(M-3)

wherein $R_{31}$ represents a diffusion resistant group having from 8 to 32 carbon atoms in total; $R_{32}$ represents a phenyl group or a substituted phenyl group; $R_{33}$ represents a hydrogen atom or a substituent; Z represents a non-metallic atomic group necessary to form a 5-membered azole ring containing two to four nitrogen atoms, which azole ring may have one or more substituents (including a condensed ring); and $X_2$ represents a hydrogen atom or a group which releases upon reaction with an aromatic primay amine developing agent.

Among the pyrazoloazole type couplers, imidazo-[1,2-b]pyrazoles as described in U.S. Pat. No. 4,500,630 are preferred, and pyrazolo[1,5-b][1,2,4]triazoles as described in U.S. Pat. No. 4,540,654 are particularly preferred in view of less yellow subsidiary absorption and light fastness of the dyes formed.

In addition, pyrazolotriazole couplers wherein a branched chain alkyl group is directly connected to the 2-, 3- or 6-position of the pyrazolotriazole ring as described in JP-A-61-65245, pyrazoloazole couplers containing a sulfonamido group in their molecules as described in JP-A-61-65246, pyrazoloazole couplers having an alkoxyphenylsulfonamido ballast group as described in JP-A-61-147254, and pyrazolotriazole couplers having an alkoxy group at the 6-position as described in EP-A-226849 are preferably employed.

Specific examples of the magenta couplers used in the present invention are set forth below, but the present invention should not be construed as being limited thereto.

| Compound | $R_{33}$ | $R_{34}$ | $X_2$ |
|---|---|---|---|
| | | 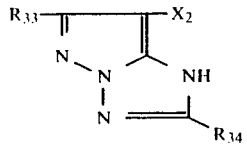 | |
| M-1 | $CH_3$— | 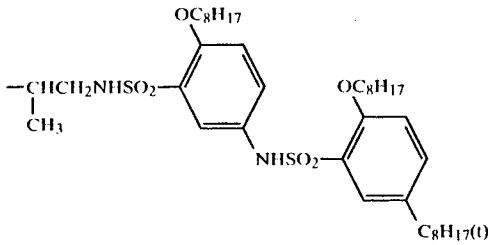 | Cl |
| M-2 | $CH_3$— | 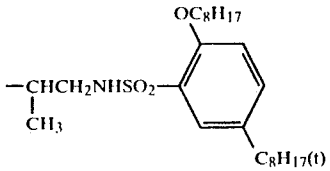 | Cl |
| M-3 | $CH_3$— | 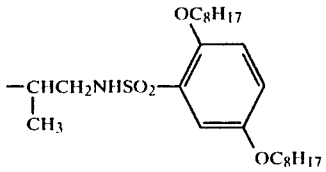 | 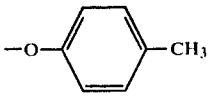 |
| M-4 | $CH_3$—NHCNH— (O) | 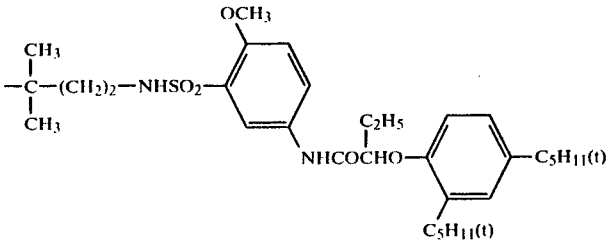 | 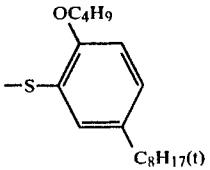 |

-continued
| Compound | $R_{33}$ | $R_{34}$ | $X_2$ |
|---|---|---|---|
| M-5 | $CH_3$— | 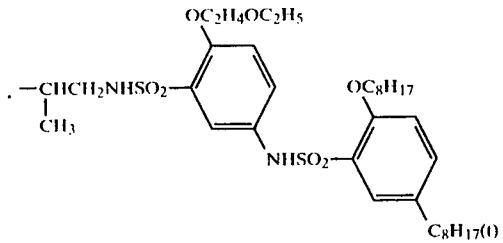 | Cl |
| M-6 | $CH_3$— | 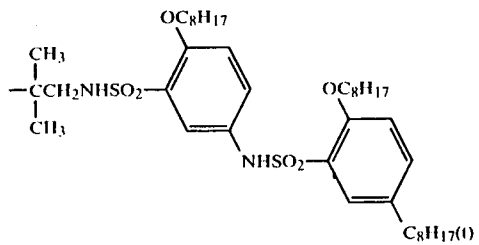 | Cl |
| M-7 | 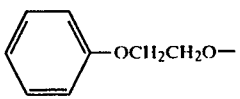 | 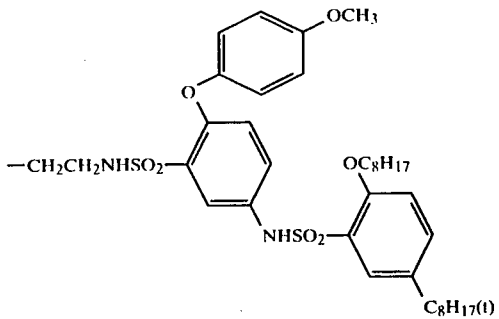 | 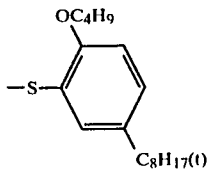 |
| M-8 | $CH_3CH_2O$— | as above | as above |

-continued
| Compound | $R_{33}$ | $R_{34}$ | $X_2$ |
|---|---|---|---|
| M-9 | $CH_3CH_2O-$ | 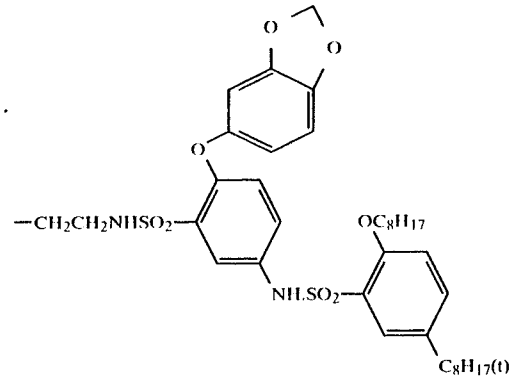 | as above |
| M-10 | 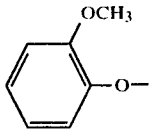 | 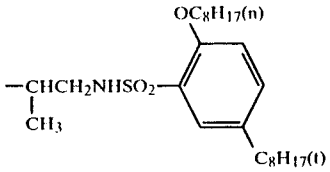 | Cl |
| | 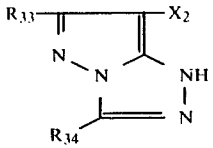 | | |
| M-11 | $CH_3-$ | 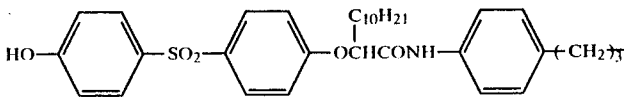 | Cl |
| M-12 | $CH_3-$ | 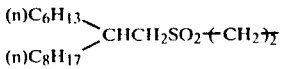 | Cl |

-continued
| Compound | $R_{33}$ | $R_{34}$ | $X_2$ |
|---|---|---|---|
| M-13 | 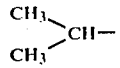 | 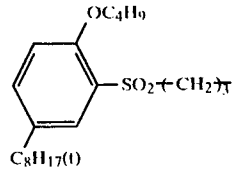 | Cl |
| M-14 | 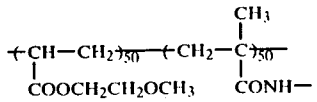 | 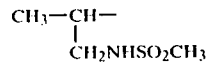 | as above |
| M-15 | | 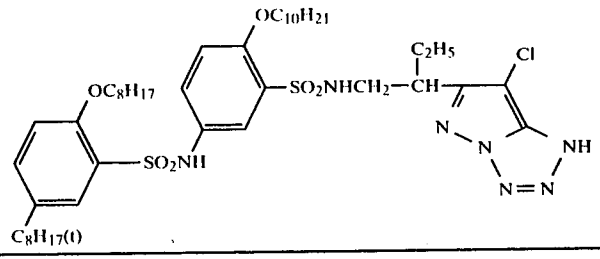 | |

Preferred high-boiling organic solvents for use with the compound represented by the general formulae (II) or (III) in the present invention include those having a boiling point of about 160° C. or above at amospheric pressure. For examples, esters (for example, phosphonic acid esters, phthalic acid esters, or benzoic acid esters, etc.), phenols, aliphatic alcohols, carboxylic acids, ethers, amides (for example, fatty acid amides, benzoic acid amides, sulfonic acid amides, or cyclic imides), aliphatic hydrocarbons, halogenated compounds, sulfone derivatives, etc. are exemplified. In order to dissolve photographic additives such as couplers in the high-boiling organic solvent, a low-boiling organic solvent (auxiliary solvent) having a boiling point of from about 30° C. to about 160° C., such as a lower alkyl ester (for example, ethyl acetate, butyl acetate, or ethyl propionate), secondary butyl alcohol, methyl isobutyl ketone, cyclohexanone, β-ethoxyethyl acetate, dimethylformamide, etc., may be added together, if desired. The mixture is emulsified and dispersed in an aqueous solution of hydrophilic colloid, and the emulsified dispersion is then mixed with a photographic emulsion. The low-boiling organic solvent may be separately removed by condensation under reduced pressure or by washing with water. Removal of the solvent means such that the amount of the low boiling point solvent organic solvent directly before coating to a support is preferably not more than 5 wt% based on the amount of water in the coating solution.

The amount of high-boiling organic solvent to be used is in a range from 0 part to 20 parts by weight, preferably from 0.2 part to 3 parts by weight to a photographic additive such as a coupler.

Preferred specific examples of high-boiling organic solvents for use in the present invention are set forth below.

$O{=}P{+}OCH_2\overset{C_2H_5}{\overset{|}{C}}HC_4H_9)_3$ (O-1)

$O{=}P{+}OCH_2CH_2\overset{CH_3}{\overset{|}{C}}HCH_2\overset{CH_3}{\overset{|}{\underset{CH_3}{\underset{|}{C}}}}{-}CH_3)_3$ (O-2)

$O{=}P{+}OC_{12}H_{25})_3$ (O-3)

$O{=}P{+}OCH_2CH_2OC_4H_9)_3$ (O-4)

$O{=}P{+}OCH_2CH_2CH_2Cl)_3$ (O-5)

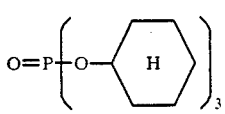

(O-6)

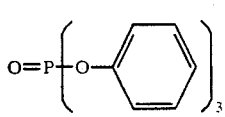

(O-7)

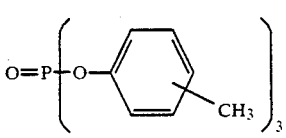

(m. p mixture) (O-8)

-continued

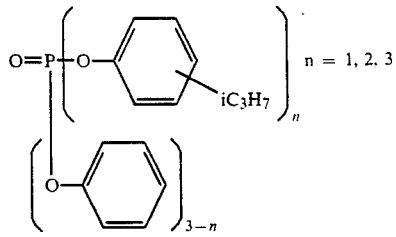

n = 1, 2, 3 (O-9)

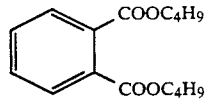

(O-10)

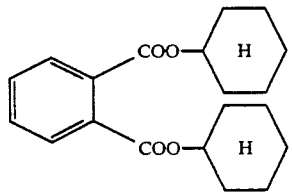

(O-11)

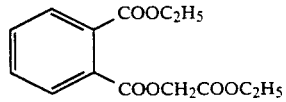

(O-12)

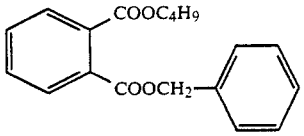

(O-13)

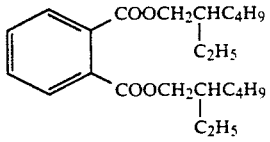

(O-14)

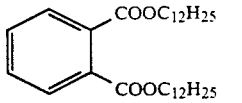

(O-15)

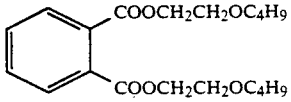

(O-16)

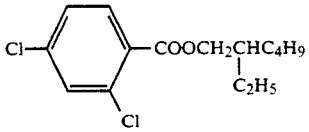

(O-17)

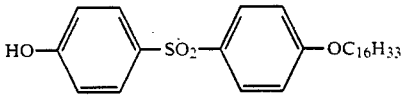

(O-18)

-continued (O-19)

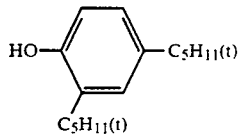

(O-20)

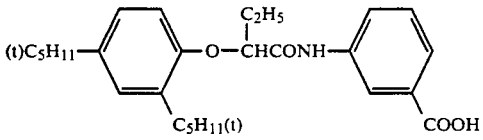

(O-21)

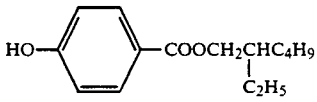

(O-22)

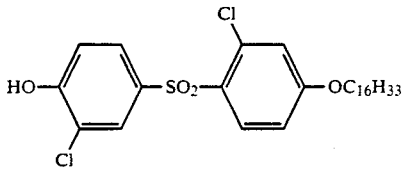

(O-23)

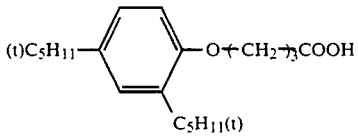

(O-24) $C_8H_{17}CH{=}CH(CH_2)_7COOC_4H_9$ (O-25)

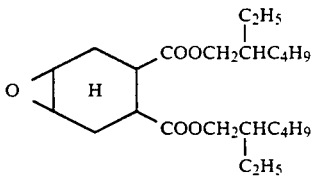

(O-26)

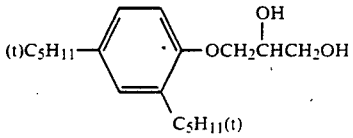

(O-27) $(C_2H_5)_2NCO(CH_2)_8COOCH_2CHC_4H_9$ ($C_2H_5$)

(O-28) $C_nH_{2n+2}$ n = 10~20 (paraffin)

(O-29) $CH_3COCH_2COOC_{12}H_{25}$ (O-30)

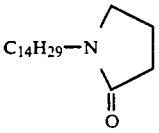

(O-31)

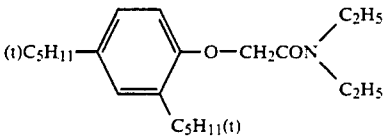

-continued (O-32)

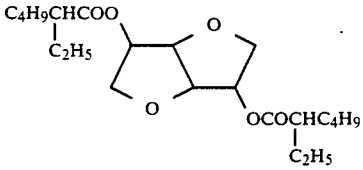

(O-33) $C_{12}H_{18}Cl_8$ (chlorinated paraffin)

(O-34)

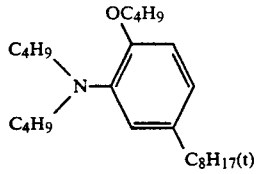

(O-35)

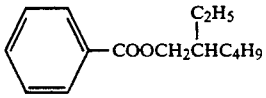

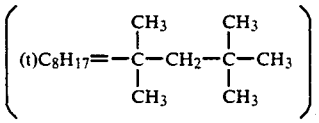

The effect according to the present invention is further achieved by using at least one ultraviolet light absorbing agent in the silver halide photographic material. These ultraviolet light absorbing agents may be added to any appropriate layer. Preferably, it is incorporated into a layer containing the cyan coupler according to the present invention or a layer adjacent thereto. Ultraviolet light absorbing agents to be used in the present invention are those compounds which are listed in *Research Disclosure*, No. 17643, VII-C, and are preferably benzotriazole derivatives represented by the following general formula (XI):

(XI)

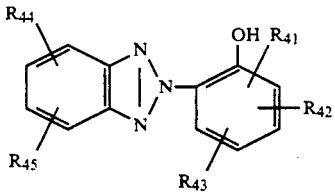

wherein $R_{41}$, $R_{42}$, $R_{43}$, $R_{44}$, and $R_{45}$, which may be the same or different, each represents a hydrogen atom or a substituent given for the aliphatic group or aromatic group represented by $R_1$ in the general formula (I), or $R_{44}$ and $R_{45}$ may combine with each other to form a 5-membered or 6-membered aromatic ring composed of carbon atoms. These groups or the aromatic ring may further be substituted with a substituent.

The compound represented by the general formula (XI) may be used alone or in combination thereof. Typical examples of the ultraviolet light absorbing agent used in the present invention are set forth below. In the following, the chemical structure of the

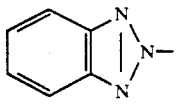
skeleton may form the
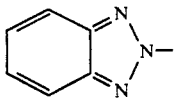
structure due to tautomerism.
(UV-1)
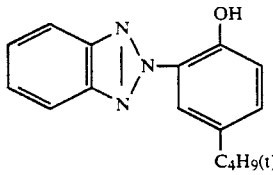
(UV-2)
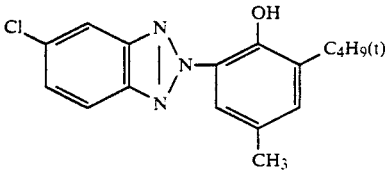
(UV-3)
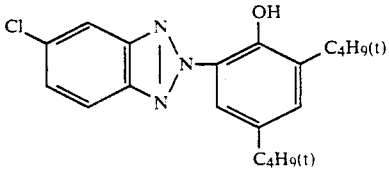
(UV-4)
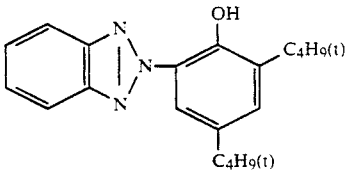
(UV-5)
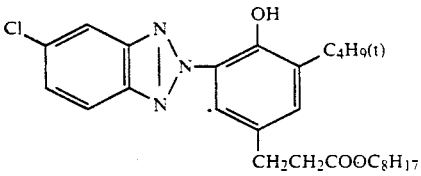
(UV-6)
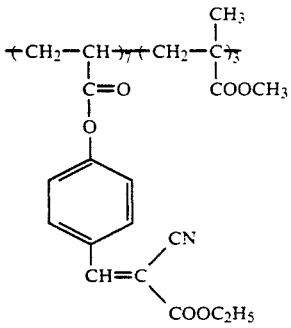
(UV-7)
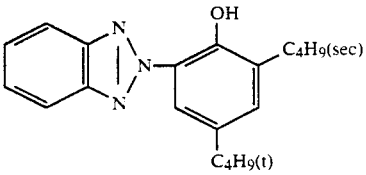
-continued
(UV-8)
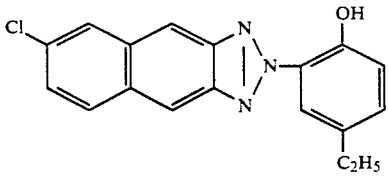
(UV-9)
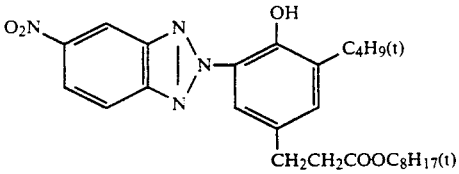
(UV-10)
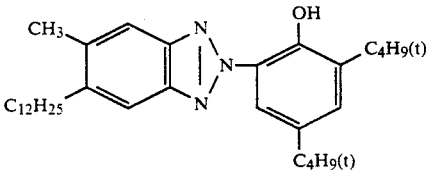
(UV-11)
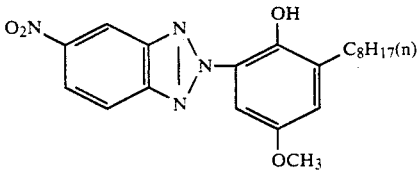
(UV-12)
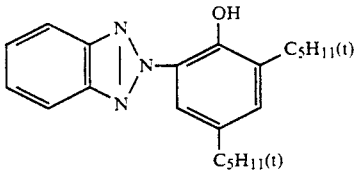
(UV-13)
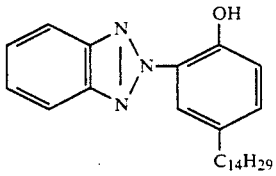
(UV-14)
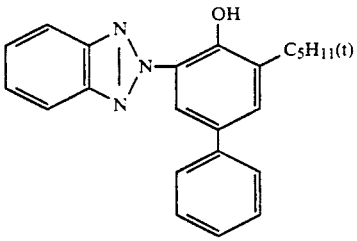
(UV-15)
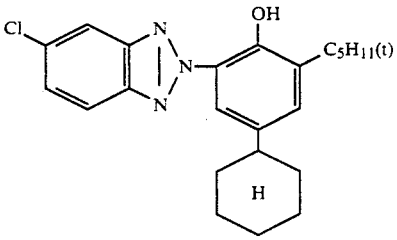

-continued

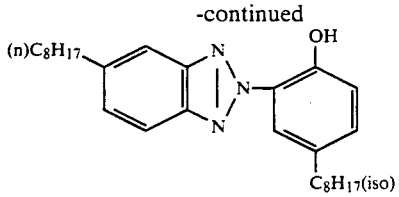

(UV-16)

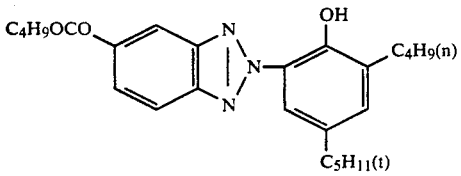

(UV-17)

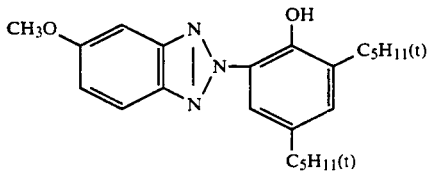

(UV-18)

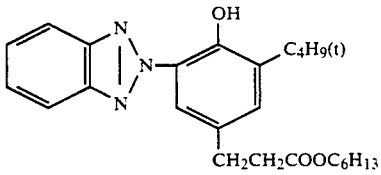

(UV-19)

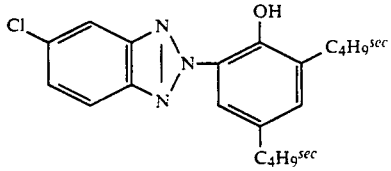

(UV-20)

Methods for synthesizing the compound represented by the general formula (XI) described above or examples of other ultraviolet light absorbing agents are described, for example, in JP-B-44-29620 (the term "JP-B" as used herein means an "examined Japanese patent publication"), JP-A-50-151149, JP-A-54-95233, U.S. Pat. No. 3,766,205, European Patent 0057160, and *Research Disclosure*, No. 22519 (1983). In addition, high molecular weight ultraviolet light absorbing agents as described, for example, in JP-A-58-111942, JP-A-58-178351 (British Patent 2,118,315A), U.S. Pat. No. 4,455,368, JP-A-59-19945 and JP-A-59-23344 (British Patent 2,127,569A) can be employed. A specific example thereof has been shown as UV-6. Low molecular weight ultraviolet light absorbing agents and the high molecular weight ultraviolet light absorbing agents may be used in combination.

The above-described ultraviolet light absorbing agent is emulsified and dispersed in a hydrophilic colloid in the same manner as described for the coupler above.

The amounts of the high-boiling organic solvent and the ultraviolet light absorbing agent are not particularly limited, but the high-boiling organic solvent is usually used in an amount of less than 300% based on the weight of the ultraviolet light absorbing agent. Compounds which are liquid at an ordinary temperature are preferably used alone or in combination.

Combined use of the ultraviolet light absorbing agent represented by the above described general formula (XI) with the coupler according to the present invention serves to improve preservability, particularly light fastness, of formed dye images, especially cyan images. The ultraviolet light absorbing agent may be coemulsified with the cyan coupler.

The ultraviolet light absorbing agent is added in an enough amount to impart sufficient stability to the cyan dye image against light but, when used in excess, it occasionally causes yellowing of unexposed portions (white background) of the color photographic material. Therefore, the amount is usually selected between $1\times10^{-4}$ mole/m$^2$ and $2\times10^{-3}$ mole/m$^2$, particularly $5\times10^{-4}$ mole/m$^2$ to $1.5\times10^{-3}$ mole/m$^2$ of the photographic material.

Suitable examples of color mixing preventing agents which can be used in the present invention include hydroquinones and other various reducing agents. Most representative compounds are alkyl hydroquinones, and these are usually employed in an intermediate layer. Suitable examples of monoalkyl-substituted hydroquinones for use in the present invention are described, for example, in U.S. Pat. Nos. 2,360,290, 2,419,613, 2,403,721, 3,960,570 and 3,700,453, JP-A-49-106329, and JP-A-50-156438, and those of dialkyl-substituted hydroquinones are described, for example, in U.S. Pat. Nos. 2,728,659, 2,732,300, 3,243,294 and 3,700,453, JP-A-50-156438, JP-A-53-9528, JP-A-53-55121, JP-A-54-29637 and JP-A-60-55339.

Alkyl hydroquinones preferably used as color mixing preventing agents in the present invention are those represented by the following general formula (XII):

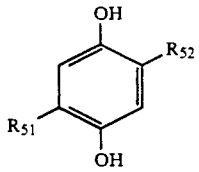

(XII)

wherein $R_{51}$ and $R_{52}$, which may be the same or different, each represents a hydrogen atom or a substituted or unsubstituted alkyl group, preferably containing from 1 to 20 carbon atoms (for example, methyl, tert-butyl, n-octyl, sec-octyl, tert-octyl, sec-dodecyl, tert-pentadecyl, or sec-octadecyl), and at least one of $R_{51}$ and $R_{52}$ is an alkyl group.

Hydroquinone sulfonates are also preferably employed as color mixing preventing agents as described, for example, in U.S. Pat. No. 2,701,197, and JP-A-60-72040. Hydroquinone sulfonates preferably used as color mixing preventing agents in the present invention are those represented by the following general formula (XIII):

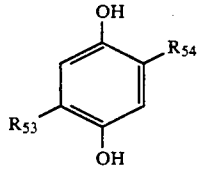

(XIII)

wherein $R_{53}$ represents a substituted or unsubstituted alkyl group, alkylthio group, amido group or alkoxy group; and $R_{54}$ represents a sulfo group or a sulfoalkyl group (for example, sulfopropyl).

Further, amidohydroquinones are preferably employed as color mixing preventing agents as described, for example, in JP-A-59-202465, JP-A-62-150346, and JP-A-62-103638. Amidohydroquinones preferably used as color mixing preventing agents in the present invention are those represented by the following general formula (XIV):

(XIV)

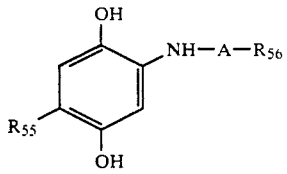

wherein $R_{55}$ represents a hydrogen atom, a halogen atom, a substituted or unsubstituted alkyl group; A represents $$-\overset{O}{\overset{\|}{C}}-$$

or $-SO_2-$; and $R_{56}$ represents a substituted or unsubstituted alkyl group or aryl group.

In addition to the above described alkyl hydroquinones, hydroquinone sulfonates and amidohydroquinones, hydroquinones having an electron withdrawing substituent as described, for example, in JP-A-55-43521, JP-A-56-109344 and JP-A-57-22237 are preferably employed as color mixing preventing agents.

Specific examples of hydroquinones preferably employed as color mixing preventing agents are set forth below.

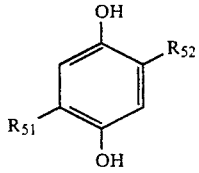

| Compound | $R_{51}$ | $R_{52}$ |
|---|---|---|
| HQ-1 | $(t)C_8H_{17}-$ | $-C_8H_{17}(t)$ |
| -2 | $(t)C_6H_{13}-$ | $-C_6H_{13}(t)$ |
| -3 | $(sec)C_8H_{17}-$ | $-C_8H_{17}(sec)$ |
| -4 | $(n)C_8H_{17}-$ | $-C_8H_{17}(n)$ |
| -5 | $CH_3-$ | $-C_8H_{17}(t)$ |
| -6 | " | $-C_{18}H_{37}(sec)$ |
| -7 | $(n)C_{16}H_{33}-$ | $-SO_3Na$ |
| -8 | $(n)C_{16}H_{33}S-$ | " |
| -9 | H | 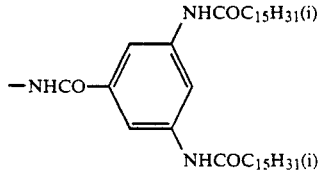 |
| -10 | " | 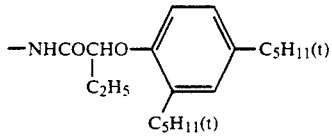 |
| -11 | $(n)C_{15}H_{31}-$ | 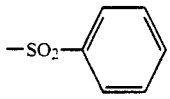 |
| -12 | H | 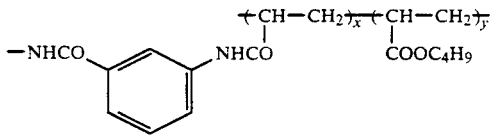 x:y = 2:5<br>Average molecular weight: about 20,000 |

Reducing agents having a skeleton other than a hydroquinone may also be employed as color mixing preventing agents. Suitable examples thereof include gallic acid amides as described, for example, in JP-A-58-156933, sulfonamido phenols as described, for example, in JP-A-59-5247 and JP-A-59-202465.

Specific examples of such reducing agents are set forth below.

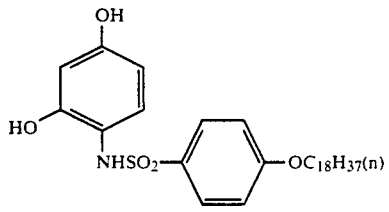

(RD-1)

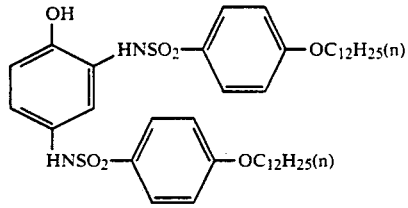

(RD-2)

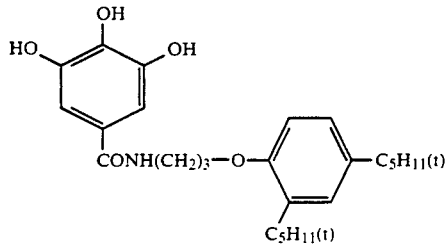

(RD-3)

In order to improve preservability of color dye images, particularly yellow and magenta color images, various organic type or metal complex type color fading preventing agents can be used in combination. Organic color fading preventing agents include hydroquinones, gallic acid derivatives, p-alkoxyphenols and p-oxyphenols and suitable examples of dye image stabilizers, antistaining agents and antioxidants are described, for example, in the patents cited in *Research Disclosure*, No. 17643, "VII I" and "VII J". Further, suitable examples of metal complex color fading preventing agents are described, for example, in *Research Disclosure*, No. 15162.

For the purpose of improving fastness of yellow color images to heat and light, many compounds including phenols, hydroquinones, hydroxychromans, hydroxycoumarans, hindered amines, and alkyl ethers or silyl ethers or hydrolizable precursor derivatives thereof can be employed.

The photographic light-sensitive material according to the present invention may contain water-soluble dyes as filter dyes or for irradiation prevention or for various other purposes in the hydrophilic colloid layers. Examples of such water-soluble dyes include oxonol dyes, hemioxonol dyes, styryl dyes, merocyanine dyes, cyanine dyes, and azo dyes. In these dyes, oxonol dyes, hemioxonol dyes, and merocyanine dyes are useful.

As the binder or protective colloids which can be used for the emulsion layers of the photographic light-sensitive material according to the present invention, gelatin is advantageously used, but other hydrophilic colloids can be used alone or together with gelatin.

Lime-treated gelatin or acid-treated gelatin can be used in the present invention. Details of the production of gelatin are described in Arthur Weiss, *The Macromolecular Chemistry of Gelatin*, published by Academic Press, 1964.

For the silver halide emulsion layers of the photographic light-sensitive material according to the present invention, any of silver bromide, silver iodobromide, silver iodochlorobromide, silver chlorobromide, and silver chloride is used as the silver halide. Of these, it is preferred to use a silver chloride emulsion or a silver chlorobromide emulsion having an average silver chloride content of 90 mol% or more in view of a rapid processing. Moreover, it is preferred to use a silver chlorobromide emulsion having an average silver chloride content of from 98 to 99.9 mol% in view of the sensitivity and fogging.

There is no particular restriction on the average grain size (the grain size being defined as the diameter of the grains of an equivalent volume sphere or as the length of the edge when the grain has a cubic form, being averaged based on projected area of the grains) of the silver halide grains in the photographic emulsions but it is preferred that the grain size be not more than 2 μm.

Grain size distribution of the silver halide grains used in the present invention may be either narrow or broad. However, it is preferred to employ a monodispersed silver halide emulsion having a coefficient of variation of not more than 15%.

The silver halide grains in the photographic emulsion layers may have a regular crystal form such as cubic, octahedral, etc., or an irregular crystal form such as spherical, tabular, etc., or may have a composite form of these crystal structures. Also, a mixture of grains having various crystal forms may be used. Of these emulsions, the use of a photographic emulsion having a regular crystal form is preferred. Moreover, of the regular crystals, a cubic or tetradecahedral is preferred.

Further, a silver halide emulsion wherein tabular silver halide grains having a diameter/thickness ratio of at least 5 accounts for at least 50% of the total projected area of the silver halide grains may be used in the present invention.

The silver halide grains used in the present invention may have a composition or structure inside the grain which is different from that on the surface layer thereof. Also, the silver halide grains may be of the type that latent images are formed mainly on the surface thereof or of the type that latent images are formed mainly in the interior thereof.

During the formation or physical ripening of the silver halide grains, a cadmium salt, a zinc salt, a thallium salt, a lead salt, an iridium salt or a complex salt thereof, a rhodium salt or a complex salt thereof, an iron salt or a complex salt thereof, etc., may coexist in the system.

The silver halide emulsions for use in the preset invention are usually chemically sensitized.

The silver halide emulsions used in the present invention can contain various kinds of compounds for preventing the occurrence of fog or for stabilizing photographic performance during the production, storage and/or photographic processing of photographic light-sensitive materials. Examples of such compounds include many compounds known as antiforggants or stabilizers such as azoles (for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole, etc.), mercaptopyrimidines, mercaptotriazines, etc.; thioketo compounds such as oxazolinethione, etc.; azaindenes (for example, triazaindenes, tetraazaindenes, in particular, 4-hydroxy-substituted 1,3,3a,7-tetraazaindene), pentaazaindenes, etc.; benzenethiosulfonic acid, benzenesulfinic acid, benzenesulfonic acid amide, etc.

The present invention can be applied to multilayer multicolor photographic materials comprising layers of at least two different spectral sensitivities on a support. Multilayer naturalcolor photographic materials generally have at least a red-sensitive emulsion layer, a green-sensitive emulsion layer, and a blue-sensitive emulsion layer on a support. The order of these layers can be suitably selected as required. Generally, the red-sensitive emulsion layer contains a cyan forming coupler, the green-sensitive emulsion layer contains a magenta forming coupler, and the blue-sensitive emulsion layer contains a yellow forming coupler, but other combinations can be adopted if desired.

Supports for use in the present invention include those conventionally employed in photographic light-sensitive materials, for example, cellulose nitrate films, cellulose acetate films, cellulose acetate butyrate films, cellulose acetate propionate films, polystyrene films, polyethylene terephthalate films, polycarbonate films, laminates of these films, thin glass films, papers, etc. Paper coated or laminated with baryta or an $\alpha$-olefin polymer, in particular, a polymer of an $\alpha$-olefin having 2 to 10 carbon atoms, such as polyethylene, polypropylene or ethylenebutene copolymer, vinyl chloride resin containing a reflective material such as titatium dioxide, and a support such as a plastic film having a roughened surface for improving the adhesion with other polymers as described in JP-B-47-19068 give good results. Also, a resin hardenable by the irradiation of ultraviolet rays can be used.

Depending on the use of the photographic light-sensitive material, a transparent support or an opaque support may be used. Also, a colored transparent support containing dyes or pigments can also be used.

Opaque supports for use in the present invention include paper which is inherenthy opaque and transparent films opacified by the incorporation of dyes or pigments such as titanium oxide. Also, plastic films surface-treated by the method as described in JP-B-47-19068, and paper or plastic·films completely shielded from light by the addition of carbon black or dyes can be used.

A conventional subbing layer is usually provided on the support. Furthermore, for improving adhesion pretreatments such as corona discharge, ultraviolet irradiation, or flame treatment may be applied to the surface of the support.

The color photographic light-sensitive materials according to the present invention are suitable for use as conventional color photographic materials, particularly color photographic light-sensitive materials for printing.

For development processing of the color photographic light-sensitive material according to the present invention, a color developing solution is employed.

The color developing solution which can be used is an alkaline aqueous solution containing preferably an aromatic primary amine type color developing agent as a main component. As the color developing agent, while aminophenol type compounds are useful, a p-phenylenediamine type compound is preferably employed. Typical examples of the p-phenylenediamine type compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, or sulfate, hydrochloride, or p-toluenesulfonate thereof.

Two or more kinds of color developing agents may be employed in a combination thereof, depending on the purpose.

The color developing solution can ordinarily contain pH buffering agent such as carbonates, borates or phosphates of alkali metals; and development inhibitors or anti-fogging agents such as bromides, iodides, benzimidazoles, benzothiazoles, or mercapto compounds. Further, if necessary, the color developing solution may contain various preservatives such as hydroxylamine, diethylhydroxylamine, sulfites, hydrazines, phenylsemicarbazides, triethanolamine, catechol sulfonic acids, or triethylenediamine(1,4-diazabicyclo[2,2,2]-octane); organic solvents such as ethylene glycol, or diethylene glycol; development accelerators such as benzyl alcohol, polyethylene glycol, quarternay ammonium salts, or amines; dye forming couplers; competing couplers; fogging agents such as sodium borohydride; auxiliary developing agents such as 1-phenyl-3-pyrazolidone; viscosity imparting agents; and various chelating agents represented by aminopolycarboxylic acids, aminopolyphosphonic acids, alkylphosphonic acids, phosphonocarboxylic acids. Representative examples of the chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid), and salts thereof. It is preferred that benzyl alcohol is not substantially employed as a development accelerator in view of prevention from environmental factors. Substantially means not more than 0.5 mol/1, and 0 mol/1 is more preferred.

In case of conducting reversal processing, color development is usually conducted after black-and-white development. In the black-and-white developing solution for revarsal processing, known black-and-white developing agents, for example, dihydroxybenzenes such as hydroquinone, 3-pyrazolidones such as 1-phenyl-3-pyrazoldione, or aminophenols such as N-methyl-p-aminophenol may be employed individually or in a combination.

The pH of the color developing solution or the black-and-white developing solution is usually in a range from 9 to 12. Further, an amount of replenishment for the developing solution can be varied depending on color photographic light-sensitive materials to be processed, but is generally not more than 3 liters per square meter of the photographic light-sensitive material. The amount of replenishment can be reduced to not more than 500 ml by decreasing the bromide ion concentration in the replenisher. In the case of reducing the replenishment amount, it is preferred to prevent evaporation and aerial oxidation of the processing solution by means of reducing an area of a processing tank which is contact with the air. Further, the amount of replenishment can be reduced using a means which limits accumulation of bromide ion in the developing solution.

After color development, the photographic emulsion layers are usually subjected to a bleach processing. The bleach processing can be performed simultaneously with a fix processing (bleach-fix processing), or it can be performed independently from the fix processing. Further, for the purpose of rapid processing, a processing method wherein after a bleach processing a bleach-fix processing is conducted may be employed. Depending on the purpose, it may be appropriate to use a continuous two tank bleach-fixing bath, to carry out fix processing before bleach-fix processing, or to conduct bleach processing after bleach-fix processing.

Examples of bleaching agents which can be employed in the bleach processing or bleach-fix processing include compounds of a multivalent metal such as iron(III), cobalt(III), chromium(VI), or copper(II); peracids; quinones; or nitro compounds. Representative examples of the bleaching agents for use in the present invention include ferricyanides; dichloromates; organic complex salts of iron(III) or cobalt(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, or glycol ether diaminetetraacetic acid), or complex salts of organic acids (such as citric acid, tartaric acid, or malic acid); persulfates; bromates; permanganates; or nitrobenzenes. Of these compounds, iron(III) complex salts of aminopolycarboxylic acids represented by the iron (III) complex salt of ethylenediaminetetraacetic acid and the persulfates are preferred in view of rapid processing and environmental factors. Furthermore, iron(III) complex salts of aminopolycarboxylic acids are particularly useful in both bleaching solutions and bleach-fixing solutions.

The pH of the bleaching solution or bleach-fixing solution containing an iron (III) complex salt of aminopolycarboxylic acid for use in the present invention is usually in a range of from 5.5 to 8. For the purpose of rapid processing, it is possible to process at a pH lower than the above described range.

In the bleaching solution, the bleach-fixing solution or a prebath thereof, a bleach accelerating agent can be used, if desired. Specific examples of suitable bleach accelerating agents for use in the present invention include compounds having a mercapto group or a disulfide group as described, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure*, No. 17129 (July 1978); thiazolidine derivatives as described, for example, in JP-A-50-140129; thiourea derivatives as described, for example, in JP-B-45-8506, JP-A-52-20832, JP-A-53-32735 and U.S. Pat. No. 3,706,561; iodides as described, for example, in West German Patent 1,127,715 and JP-A-58-16235; polyoxyethylene compounds as described, for example, in West German Patents 966,410 and 2,748,430; polyamine compounds as described, for example, in JP-B-45-8836; compounds as described, for example, in JP-A-49-42434, JP-A-49-59644, JP-A-53-94927, JP-A-54-35727, JP-A-55-26506 and JP-A-58-163940; and bromide ions. Of these compounds, the compounds having a mercapto group or a disulfide group are preferred in view of their powerful bleach accelerating effects. Particularly, the compounds as described in U.S. Pat. No. 3,893,858, West German Patent 1,290,812 and JP-A-53-95630 are preferred. Further, the compounds as described in U.S. Pat. No. 4,552,834 are also preferred. These bleach accelerating agents may also be incorporated into the color photographic light-sensitive material. These bleach accelerating agents are particularly effectively employed when color photographic light-sensitive materials for photographing are subjected to bleach-fix processing.

Fixing agents for use in the present invention which can be employed in the fixing solution or bleach-fixing solution include thiosulfates, thiocyanates, thioether compounds, thioureas, or a large amount of iodide. Of these compounds, thiosulfates are generally employed. Particularly, ammonium thiosulfate is most widely employed. Sulfites, bisulfites or carbonylbisulfite adducts are preferably used as preservatives in the bleach-fixing solution.

After the desilvering step, the silver halide color photographic material according to the present invention is generally subjected to a water washing step and/or a stabilizing step.

The amount of water required for the water washing step varies depending on the characteristics of photographic light-sensitive materials (due to elements used therein, for example, couplers), uses thereof, temperature of the washing water, the number of water washing tanks (stages), the replenishment system employed such as countercurrent or orderly current, or other various conditions. The relationship between the number of water washing tanks and an amount of water in a multistage countercurrent system can be determined based on the method as described in *Journal of the Society of Motion Picture and Television Engineers*, Vol. 64, pages 248 to 253 (May, 1955).

According to the multi-stage countercurrent system described in the above literature, the amount of water for washing is significantly reduced. However, the increase in residence time of water in a tank causes propagation of bacteria and other problems, for example, adhesion of foreign material on the photographic materials. In the method of processing the silver halide color photographic material according to the present invention, a method for reducing the amounts of calcium ion and magnesium ion as described in JP-A-62-288838 is particularly effectively employed in order to solve such problems. Further, sterilizers, for example, isothiazolone compounds as described in JP-A-57-8542, thiabendazoles, chlorine type sterilizers such as sodium chloroisocyanurate, benzotriazoles, sterilizers as described in Hiroshi Horiguchi, *Bokin-Bobaizai No Kagaku, Biseibutsu No Mekkin-, Sakkin-, Bobai-Gijutsu*, edited by Eiseigijutsu Kai, and *Bokin-Bobaizai Jiten*, edited by Nippon Bokin-Bobai Gakkai can be employed.

The pH of the washing water used in the processing of the photographic light-sensitive materials according to the present invention is usually from 4 to 9, preferably from 5 to 8. The temperature of the washing water and time for the water washing step is set depending on characteristics or uses of photographic light-sensitive materials. However, a temperature range of from 15° C. to 45° C. and time period from 20 sec. to 10 min. and preferably a range of from 25° C. to 40° C. and a period from 30 sec. to 5 min is generally employed.

The photographic light-sensitive material of the present invention can also be directly processed with a stabilizing solution in place of the above-described water washing step. In such a stabilizing process, any of the methods described, for example, in JP-A-57-8543, JP-A-58-14834 and JP-A-60-220345 can be employed.

Further, it is possible to conduct the stabilizing process subsequent to the above-described water washing process. One example thereof is a stabilizing bath containing formulin and a surface active agent, which is employed as a final bath in the processing of color photographic light-sensitive materials for photographing. Various chelating agents and antimolds may also be added to such a stabilizing bath.

Overflow solutions resulting from replenishment of the above-described washing water and/or stabilizing solution may be reused in other steps such as the desilvering step.

For simplification and acceleration of processing, a color developing agent may be incorporated into the silver halide color photographic material according to the present invention. Such color developing agent are preferably incorporated as precursors thereof. Suitable examples of developing agent precursors include indoaniline type compounds as described in U.S. Pat. No. 3,342,597, Schiff's base type compounds as described in U.S. Pat. No. 3,342,599 and *Research Disclosure*, No. 14850 and ibid. No. 15159, aldol compounds as described in *Research Disclosure*, No. 13924, metal salt complexes as described in U.S. Pat. No. 3,719,492, and urethane type compounds as described in JP-A-53-135628.

Further, the silver halide color photographic material according to the present invention may contain, if desired, various 1-phenyl-3-pyrazolidones for the purpose of accelerating color development. Typical examples of these compounds are described, for example, in JP-A-56-64339, JP-A-57-144547, and JP-A-58-115438.

In the present invention, various processing solutions can be employed in a temperature range from 10° C. to 50° C. Although a standard temperature is from 33° C. to 38° C., it is possible to carry out the processing at higher temperatures in order to accelerate the processing whereby the processing time is shortened, or at lower temperatures in order to improve image quality and to maintain stability of the processing solutions.

Further, for the purpose of reducing the amount of coated silver in the color photographic light-sensitive material, the photographic processing may be conducted utilizing color intensification using cobalt or hydrogen peroxide as described in West German Patent Application (OLS) No. 2,226,770 or U.S. Pat. No. 3,674,499.

The silver halide emulsion layer of the present invention is preferably formed by the steps which comprise (1) emulsifying and dispersing the cyan dye forming coupler of the general formula (I), the compound of the general formula (II) or (III) and a low-boiling organic solvent having a boiling point of from about 30° C. to about 160° C. in an aqueous solution, (2) removing the low-boiling organic solvent from the thus obtained emulsion and dispersion product, (3) mixing the emulsion and dispersion product and a silver halide emulsion, and then (4) coating the mixed solution onto the support.

In accordance with the present invention, color photographs having superior color image fastness are obtained and the silver halide emulsion does not decrease in sensitivity during storage prior to coating.

The present invention will be explained in greater detail with reference to the following examples, but the present invention should not be construed as being limited thereto.

EXAMPLE 1

Sample 101

On a paper support, both surfaces of which were laminated with polyethylene, were coated layers as shown below in order to prepare a multilayer silver halide photographic material designated Sample 101.

In the following, ethyl acetate was used together with a high boiling organic solvent, as the coupler solvent.

Construction of Layers

The compositions of the layers are described below. The coated amounts are indicated in terms of g/m$^2$ provided that the coated amounts of the silver halide emulsions are indicated in terms of g silver/m$^2$.

Support:

Polyethylene laminated paper in which the polyethylene on the first layer side contained a white pigment ($TiO_2$) and a blueish dye.

| | |
|---|---|
| First Layer: Blue-sensitive Layer | |
| Monodispersed silver chlorobromide emulsion (EM1) spectrally sensitized with Sensitizing dye (ExS-1) | 0.16 |
| Monodispersed silver chlorobromide emulsion (EM2) spectrally sensitized with Sensitizing dye (ExS-1) | 0.10 |
| Gelatin | 1.86 |
| Color image stabilizer (Cpd-1) | 0.02 |
| Yellow coupler (ExY-1) | 0.83 |
| Color image stabilizer (Cpd-15) | 0.08 |
| Solvent (Solv-1/Solv-2 = 1:1 by volume ratio) | 0.35 |
| Second Layer: Color-mixing Preventing Layer | |
| Gelatin | 0.99 |
| Color mixing preventing agent (Cpd-3) | 0.03 |
| Solvent (Solv-3) | 0.06 |
| Third Layer: Green-sensitive Layer | |
| Monodispersed silver chlorobromide emulsion (EM3) spectrally sensitized with Sensitizing dyes (ExS-2, 3) | 0.05 |
| Monodispersed silver chlorobromide emulsion (EM4) spectrally sensitized with Sensitizing dyes (ExS-2, 3) | 0.11 |
| Gelatin | 1.80 |
| Magenta coupler (M-5) | 0.39 |
| Color image stabilizer (Cpd-4) | 0.20 |
| Color image stabilizer (Cpd-5) | 0.05 |
| Color image stabilizer (Cpd-6) | 0.04 |
| Solvent (Solv-3) | 0.12 |
| Solvent (Solv-4) | 0.25 |
| Fourth Layer: Ultraviolet Light Absorbing Layer | |
| Gelatin | 1.60 |
| Ultraviolet light absorbing agent (Cpd-7/Cpd-8/Cpd-9 = 3/2/6 by weight ratio) | 0.70 |
| Color mixing preventing agent (Cpd-3) | 0.05 |
| Solvent (Solv-5) | 0.27 |
| Fifth Layer: Red-sensitive Layer | |
| Monodispersed silver chlorobromide emulsion (EM5) spectrally sensitized with Sensitizing dyes (ExS-4, 5) | 0.07 |
| Monodispersed silver chlorobromide emulsion (EM6) spectrally sensitized with Sensitizing dyes (ExS-4, 5) | 0.16 |
| Gelatin | 0.92 |
| Cyan coupler (Comparison 1) | 0.35 |
| Color image stabilizer (Cpd-1) | 0.03 |
| Color image stabilizer (Cpd-5) | 0.01 |
| Color image stabilizer (Cpd-6) | 0.04 |
| Ultraviolet light absorbing agent (Cpd-7/Cpd-9/Cpd-10 = 3/4/2 by weight ratio) | 0.17 |
| Solvent (Solv-3) | 0.20 |
| Sixth Layer: Ultraviolet Light Absorbing Layer | |
| Gelatin | 0.54 |
| Ultraviolet light absorbing agent (Cpd-7/ | 0.21 |

-continued

| | |
|---|---|
| Cpd-8/Cpd-9 = 1/5/3 by weight ratio) | |
| Color mixing preventing agent (Cpd-3) | 0.02 |
| Solvent (Solv-5) | 0.06 |
| Seventh Layer: Protective Layer | |
| Gelatin | 1.33 |
| Acryl-modified polyvinyl alcohol copolymer (modification degree: 17%) | 0.17 |
| Liquid paraffin | 0.03 |

For preventing irradiation, irradiation preventing dyes (Cpd-11, 12), were used.

To all the layers, Alkanol XC (manufactured by E.I. Du Pont de Nemours & Co.), sodium alkylbenzenesulfonate, succinic acid ester, and Megafac F-120 (manufactured by Dai Nippon Ink and Chemicals Co., Ltd.) were used as emulsifying dispersing agents and coating aids.

For stabilizing silver halide, silver halide stabilizers (Cpd-13, 14) were used.

Further, to all the layers, 2-oxy-4,6-dichloro-s-triazine sodium salt was used as a gelatin hardener, and Cpd-2 was used as a viscosity imparting agent.

The silver halide emulsions used in this example are described in detail below.

| Emulsion | Crystal Form | Average Grain size (μm) | Bromide content (mol %) | Coefficient* of variation |
|---|---|---|---|---|
| EM1 | cubic | 0.96 | 80 | 0.06 |
| EM2 | " | 0.64 | 80 | 0.07 |
| EM3 | " | 0.52 | 70 | 0.08 |
| EM4 | " | 0.40 | 70 | 0.09 |
| EM5 | " | 0.44 | 70 | 0.09 |
| EM6 | " | 0.36 | 70 | 0.08 |

*Coefficient of variation = standard deviation/average grain size

The compounds used in the above-described layers are illustrated below.

ExY-1

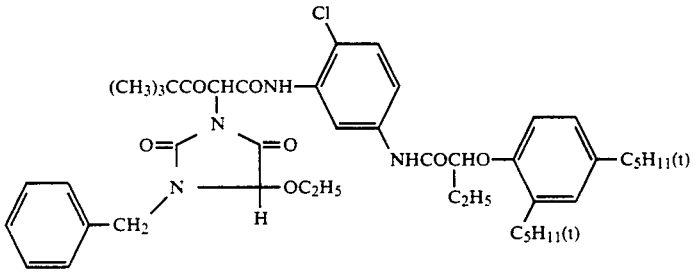

ExS-1

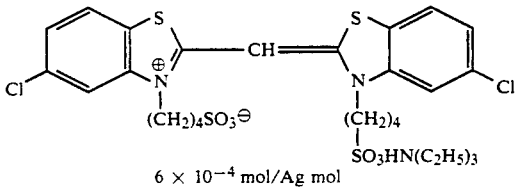

$6 \times 10^{-4}$ mol/Ag mol

ExS-2

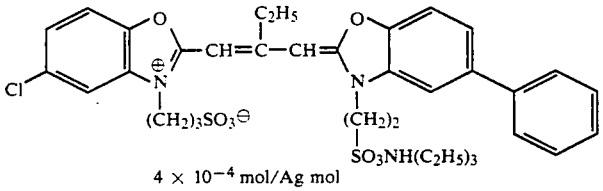

$4 \times 10^{-4}$ mol/Ag mol

ExS-3

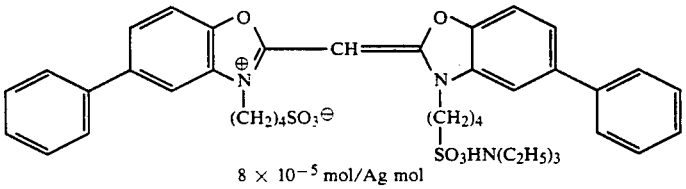

$8 \times 10^{-5}$ mol/Ag mol

ExS-4

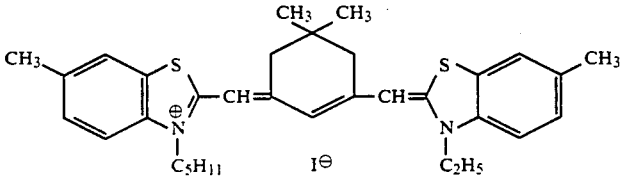

$1.8 \times 10^{-4}$ mol/Ag mol

-continued
ExS-5
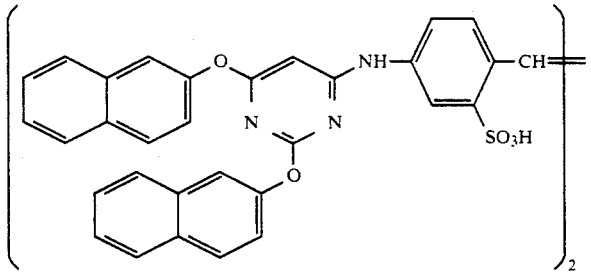
Cpd-1
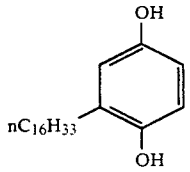
Cpd-2
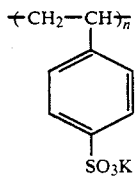
Cpd-3
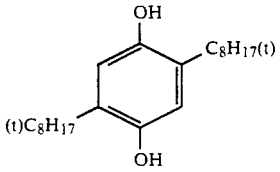
Cpd-4
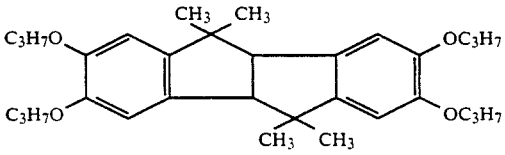
Cpd-5
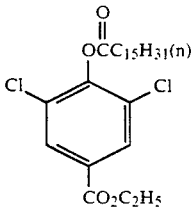
Cpd-6
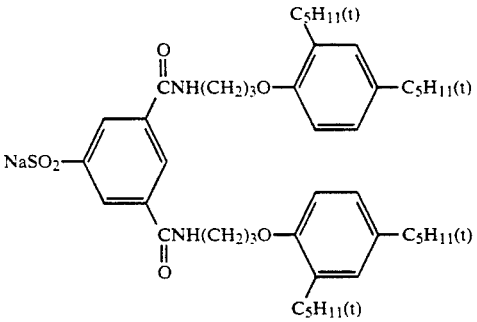
Cpd-7
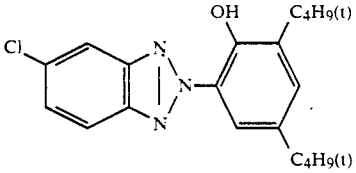
Cpd-8
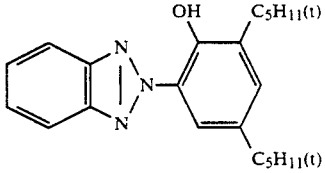
Cpd-9
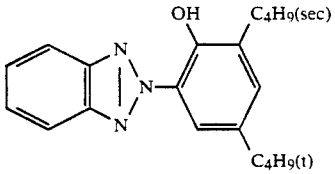
Cpd-10
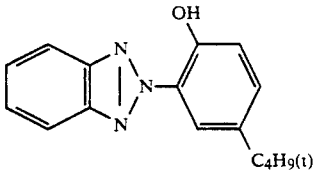
Cpd-11
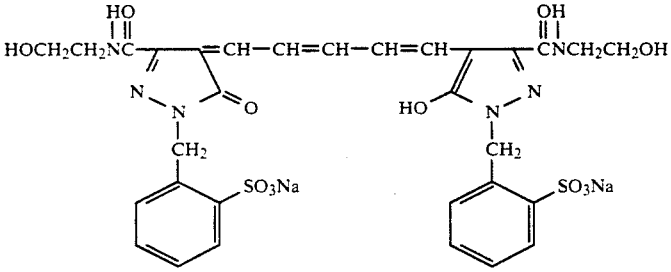

-continued

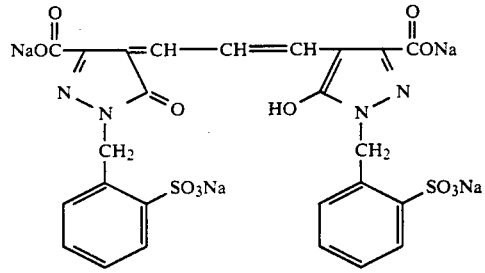

Cpd-12

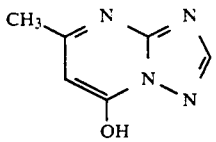

Cpd-13

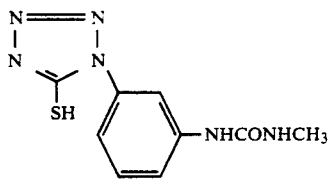

Cpd-14

$\text{-}(CH_2-CH)_n\text{-}$ | $CONHC_4H_9(t)$ (molecular weight: 80,000)

Cpd-15

$((iso)C_9H_{19}O)_3P=O$

Solv-1

$C_8H_{17}CHCH(CH_2)_7COOC_8H_{17}$ (epoxide)

Solv-2

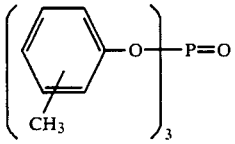

Solv-3

$(C_4H_9CHCH_2O)_3P=O$ | $C_2H_5$

Solv-4

$COOCH_2CH(C_2H_5)C_4H_9$ | $(CH_2)_8$ | $COOCH_2CH(C_2H_5)C_4H_9$

Solv-5

Samples 102 to 113

Samples 102 to 113 were prepared in the same manner as described for Sample 101 except for using the equimolar amounts of the couplers and the same weight of the coupler solvents as shown in Table 1 below in each of the red-sensitive layers.

Samples 114 to 126

Samples 114 to 126 were prepared in the same manner as described for Samples 101 to 113 except that the coating solutions for the red-sensitive layer were each stored at 40° C. for 6 hours before coating.

TABLE 1

| Sample No. | Cyan Coupler | Coupler Solvent | Removal of*1 Ethyl Acetate | Storage of Coating solution | Remark |
|---|---|---|---|---|---|
| 101 | Comparison 1*2 | Comparison A*4 | NO | — | Comparison |
| 102 | Comparison 2*3 | Comparison A | NO | — | " |
| 103 | I-28 | Comparison A | NO | — | " |
| 104 | " | Comparison B*5 | NO | — | " |
| 105 | I-20 | Comparison A | NO | — | " |
| 106 | " | Comparison C*6 | NO | — | " |
| 107 | I-28 | II-4 | NO | — | Present Invention |
| 108 | " | II-5 | NO | — | " |
| 109 | " | III-1 | NO | — | " |
| 110 | " | II-5 | YES | — | " |
| 111 | I-20 | II-5 | NO | — | " |
| 112 | | II-5 | YES | — | " |
| 113 | | II-22 | YES | — | " |
| 114 | Same as Sample 101 | | NO | 6 Hours | Comparison |
| 115 | Same as Sample 102 | | NO | " | " |
| 116 | Same as Sample 103 | | NO | " | " |
| 117 | Same as Sample 104 | | NO | " | " |
| 118 | Same as Sample 105 | | NO | " | " |
| 119 | Same as Sample 106 | | NO | " | " |
| 120 | Same as Sample 107 | | NO | " | Present Invention |
| 121 | Same as Sample 108 | | NO | " | " |
| 122 | Same as Sample 109 | | NO | " | " |
| 123 | Same as Sample 100 | | YES | " | " |
| 124 | Same as Sample 111 | | NO | " | " |
| 125 | Same as Sample 112 | | YES | " | " |

TABLE 1-continued

| Sample No. | Cyan Coupler | Coupler Solvent | Removal of*1 Ethyl Acetate | Storage of Coating solution | Remark |
|---|---|---|---|---|---|
| 126 | Same as Sample 113 | | YES | " | " |

*1"NO" denotes that ethyl acetate which had been used as an auxiliary solvent was not removed after emulsifing the dispersion of the cyan coupler and the dispersion having the auxiliary solvent was mixed with the photographic emulsion. After the removal treatment of ethyl acetate from the emulsified dispersion, the amount of ethyl acetate based on the water in the coating solution which was mixed with the silver halide emulsion was 3 wt %.
"YES" denotes that ethyl acetate was removed by distillation from the dispersion. The dispersion was then mixed with the photographic emulsion.

*2Comparison 1

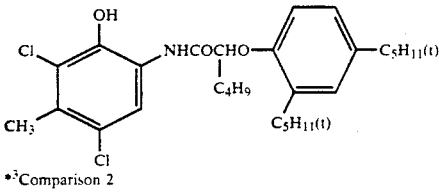

*3Comparison 2

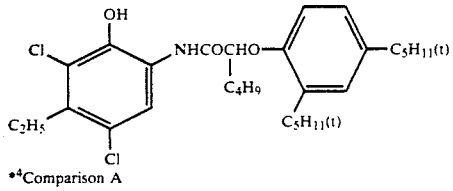

*4Comparison A

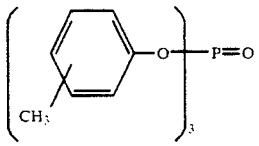

(Same as Solv-3)

*5Comparison B

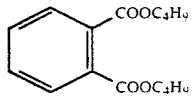

*6Comparison C

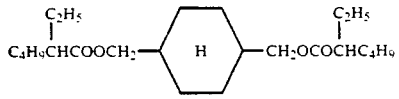

The photographic light-sensitive materials thus-prepared were imagewise exposed to light and continuously processed (a running test) according to the processing steps shown below using a Fuji Color Paper Processor PP600, until the amount of the replenisher for the color developing solution reached twice the capacity of the developing tank.

| Processing Step | Temperature (°C.) | Time | Amount of* Replenisher | Capacity of Tank |
|---|---|---|---|---|
| Color Development | 38 | 1'40" | 290 ml | 17 l |
| Bleach-Fixing | 33 | 60" | 150 ml | 9 l |
| Rinse (1) | 30 to 34 | 20" | — | 4 l |
| Rinse (2) | 30 to 34 | 20" | — | 4 l |
| Rinse (3) | 30 to 34 | 20" | 364 ml | 4 l |
| Drying | 70 to 80 | 50" | | |

*Amount of replenisher is indicated as an amount per $m^2$ of the photographic light-sensitive material.

The rinse steps were conducted using a three-tank countercurrent system from Rinse (3) to Rinse (1).

The composition of each processing solution used was as follows:

| | Tank Solution | Replenisher |
|---|---|---|
| Color Developing Solution | | |
| Water | 800 ml | 800 ml |
| Diethylenetriaminepentaacetic acid | 1.0 g | 1.0 g |
| Nitrilotriacetic acid | 2.0 g | 2.0 g |
| 1-Hydroxyethylidene-1,1-disulfonic acid | 2.0 g | 2.0 g |
| Benzyl alcohol | 16 ml | 22 ml |
| Diethylene glycol | 10 ml | 10 ml |
| Sodium sulfite | 2.0 g | 2.5 g |
| Potassium bromide | 0.5 g | — |
| Potassium carbonate | 30 g | 30 g |
| N-Ethyl-N-(β-methanesulfonamidoethyl)-3-methyl-4-aminoaniline sulfate | 5.5 g | 7.5 g |
| Hydroxylamine sulfate | 2.0 g | 2.5 g |
| Fluorescent whitening agent (WHITEX 4B, manufactured by Sumitomo Chemical Co., Ltd.) | 1.5 g | 2.0 g |
| Water to make | 1,000 ml | 1,000 ml |
| pH at 25° C. | 10.20 | 10.60 |
| Bleach-Fixing Solution | | |
| Water | 400 ml | 400 ml |
| Ammonium thiosulfate (70% soln.) | 200 ml | 300 ml |
| Sodium sulfite | 20 g | 40 g |
| Ammonium iron(III) ethylenediaminetetraacetate | 60 g | 120 g |

-continued

| | Tank Solution | Replenisher |
|---|---|---|
| Disodium ethylenediaminetetra-acetate | 5 g | 10 g |
| Water to make | 1,000 ml | 1,000 ml |
| pH at 25° C. | 6.70 | 6.30 |

Rinse Solution

Ion exchange water (contents of calcium and magnesium each being not more than 3 ppm).

Using the samples thus-processed, Evaluations (1) and (2) described below were conducted.

Evaluation (1)

With reference to the samples with which the coating solution for the red-sensitive layer was either not stored or stored (for example, Sample 101 and 114 respectively), the sensitivity difference of the red-sensitive layer was determined to evaluate the stability of the coating solution with the lapse of time. The sensitivity difference is indicated by a value of $\Delta E = \log (1/E_{Fr} - 1/E_{6hr})$ wherein $E_{Fr}$ represents an exposure amount necessary to obtain a density of 0.5 in the sample prepared using the coating solution not stored, and $E_{6hr}$ represents an exposure amount necessary to obtain a density of 0.5 in the sample prepared using the coating solution stored. When the desensitization occurs during the storage of the coating solution, the value $\Delta E$ is a negative minus number. The results are shown in Table 2 below.

TABLE 2

| Sample No. | Sensitivity Difference due to Storage (ΔE) | Remark |
|---|---|---|
| 101 (114) | −0.23 | Comparison |
| 102 (115) | −0.22 | " |
| 103 (116) | −0.41 | " |
| 104 (117) | −0.42 | " |
| 105 (118) | −0.43 | " |
| 106 (119) | −0.43 | " |
| 107 (120) | −0.12 | Present Invention |
| 108 (121) | −0.13 | Present Invention |
| 109 (122) | −0.14 | Present Invention |
| 110 (123) | −0.03 | Present Invention |
| 111 (124) | −0.12 | Present Invention |
| 112 (125) | −0.04 | Present Invention |
| 113 (126) | −0.06 | Present Invention |

The Sensitivity Difference (ΔE) is defermined between each of the indicaited sample pairs. Each sample pair comprises the same cyan coupler and coupler solvent. The red-sensitive layers in Samples 101–113 were freshly coated. The red-sensitive layers in Samples 114–126 were coated after storing the emulsion for 6 hours.

As is apparent from the results shown in Table 2, the change in sensitivity (desensitization) is small in a case wherein the coating solution was stored for 6 hours before coating wherein the combination cyan coupler and solvent of the present invention was employed. Accordingly, the photographic light-sensitive material of the present invention is well disposed to production. The effect of the present invention is particularly enhranced when the auxiliary solvent is removed prior to coating as provided in sample pairs 110(123), 112(125) and 113(126).

The reason for such an effect is not fully understood, but is presumed as follows. It is believed that sensitizing dyes adsorbed on silver halide grains desorb to form salts with the cyan couplers. Thus, the sensitizing dyes became incorporated into the oleophilic fine particles containing the cyan couplers, whereby the amount of sensitizing dye adsorbed onto the silver halide grains decreases in the coating solution during storage. In particular, the cyan couplers used in the present invention exhibit a strong interaction with these sensitizing dyes which results in large desensitization as compared with the comparison couplers.

On the contrary, by using the cyan coupler together with the coupler solvent according to the present invention, the cyan coupler is prevented from adversely affecting (particularly with respect to desensitization) the silver halide emulsion, while maintaining extremely high color image fastness as is apparent from Evaluation (2) as described below. From these results, it is clear that the photographic light-sensitive material of the present invention is superior in view of both practical use and production attributes.

Evaluation (2)

Each of Samples 101 to 113 thus-processed were stored at a temperature of 100° C. for 10 days, or in a xenon fade meter of 80,000 lux for 8 days. Then, the cyan density decrease rate in the area of the sample having an initial density of 1.5 was determined. Further, with the samples stored at 100° C. for 10 days, the degree of cyan coloration (cyan stain) in the white background was measured as the amount of cyan density increase during storage over the cyan density just after processing. The results thus-obtained are shown in Table 3 below.

Moreover, yellow density (B) and magenta density (G) were measured in the same manner as described above. The resulting color image fastness for each of the samples are within the ranges shown in Table 4 below.

TABLE 3

| Sample No. | Layer | Color Image Fastness 100° C., 10 Days (%) | Xenon, 8 Days (%) | Cyan Stain 100° C., 10 Days | Remark |
|---|---|---|---|---|---|
| 101 | R | 38 | 26 | 0.04 | Comparison |
| 102 | R | 21 | 32 | 0.03 | Comparison |
| 103 | R | 7 | 18 | 0.10 | Comparison |
| 104 | R | 7 | 19 | 0.11 | Comparison |
| 105 | R | 6 | 16 | 0.11 | Comparison |
| 106 | R | 7 | 18 | 0.11 | Comparison |
| 107 | R | 5 | 17 | 0.03 | This Invention |
| 108 | R | 5 | 16 | 0.04 | This Invention |
| 109 | R | 5 | 16 | 0.05 | This Invention |
| 110 | R | 5 | 16 | 0.03 | This Invention |
| 111 | R | 6 | 15 | 0.04 | This Invention |
| 112 | R | 5 | 15 | 0.03 | This Invention |
| 113 | R | 5 | 15 | 0.03 | This Invention |

TABLE 4

| Sample No. | Layer | Color Image Fastness 100° C., 10 Days (%) | Xenon, 8 Days (%) |
|---|---|---|---|
| 101 | B | 5–7 | 16–18 |

TABLE 4-continued

| Sample No. | Layer | Color Image Fastness 100° C., 10 Days (%) | Xenon, 8 Days (%) |
|---|---|---|---|
| to 113 | G | 4-6 | 16-18 |

As is apparent from the results shown in Table 3 and Table 4, the samples according to the present invention are excellent in any of color image fastness and in view of the total balance of yellow and magenta fading.

Further, when the coupler solvents according to the present invention are used, the stain in the white background is controlled to a smaller extent compared with the samples employing the comparative coupler solvents. Therefore, the preservability of color image formed according to the method of the present invention is superior in both these respects.

EXAMPLE 2

The same samples as described in Example 1 were prepared except the silver halide emulsions described below were used in place of the emulsions used in the blue-sensitive layer, green-sensitive layer and red-sensitive layer of the samples in Example 1 respectively.

| Layer | Emulsion | Crystal Form | Average Grain size (μm) | Bromide content (mol %) | Coefficient of variation |
|---|---|---|---|---|---|
| Blue-Sensitive Layer | EM-7 | cubic | 0.85 | 0.6 | 0.10 |
| Green-Sensitive Layer | EM-8 | cubic | 0.45 | 1.0 | 0.09 |
| Red-Sensitive Layer | EM-9 | cubic | 0.34 | 1.8 | 0.10 |

The photographic light-sensitive materials thus-prepared were exposed to light through an optical wedge and then processed continuously according to the processing steps described below.

| Processing Step | Temperature | Time |
|---|---|---|
| Color Development | 35° C. | 45 sec |
| Bleach-Fixing | 30 to 36° C. | 45 sec |
| Sabilizing (1) | 30 to 37° C. | 20 sec |
| Stabilizing (2) | 30 to 37° C. | 20 sec |
| Stabilizing (3) | 30 to 37° C. | 20 sec |
| Stabilizing (4) | 30 to 37° C. | 30 sec |
| Drying | 70 to 85° C. | 60 sec |

The stabilizing steps were conducted using a four-tank countercurrent system from Stabilizing (4) to Stabilizing (1).

The composition of each processing solution used was as follows:

| | |
|---|---|
| Color Developing Solution | |
| Water | 800 ml |
| Ethylenediaminetetraacetic acid | 2.0 g |
| Triethanolamine | 8.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-Diethylhydroxylamine | 4.2 g |
| 5,6-Dihydroxybenzene-1,2,4-trisulfonic acid | 0.3 g |
| Fluorescent brightening agent | 2.0 g |

-continued

| | |
|---|---|
| (4,4-diaminostilbene type) | |
| Water to make | 1000 ml |
| pH (25° C.) | 10.10 |
| Bleach-Fixing Solution | |
| Water | 400 ml |
| Ammonium thiosulfate (70%) | 100 ml |
| Sodium sulfite | 18 g |
| Ammonium ethylenediaminetetraacetate iron (III) | 55 g |
| Disodium ethylenediaminetetraacetate | 3 g |
| Glacial acetic acid | 8 g |
| Water to make | 1000 ml |
| pH (25° C.) | 5.5 |
| Stabilizing Solution | |
| Formaldehyde (37%) | 0.1 g |
| Formaldehyde-sulfite adduct | 0.7 g |
| 5-Chloro-2-methyl-4-isothiazolin-3-one | 0.02 g |
| 2-Methyl-4-isothiazolin-3-one | 0.01 g |
| Cupric sulfate | 0.005 g |
| Water to make | 1000 ml |
| pH (25° C.) | 4.0 |

After the development processing, the samples were evaluated in the same manner as described in Example 1. Similar results to those in Example 1 were obtained. From these results it is confirmed that the effect of the present invention is obtained even when the silver halide composition and processing steps are varied.

EXAMPLE 3

Samples identical to Sample 101 described in Example 1 were prepared except the cyan coupler and the coupler solvent used in the red-sensitive layer were substituted by those described in Table 5 shown below.

TABLE 5

| Sample No. | Cyan Coupler | Coupler solvent |
|---|---|---|
| 127 | I-2 | II-5 |
| 128 | I-4 | II-5 |
| 129 | I-6 | II-5 |
| 130 | I-7 | II-5 |
| 131 | I-9 | II-5 |
| 132 | I-10 | II-5 |
| 133 | I-11 | II-5 |
| 134 | I-12 | II-5 |
| 135 | I-19 | II-5 |
| 136 | I-23 | II-5 |
| 137 | I-24 | II-5 |
| 138 | I-25 | II-5 |
| 139 | I-29 | II-5 |
| 140 | I-32 | II-5 |
| 141 | I-43 | II-5 |
| 142 | I-45 | II-5 |

(The amount of ethyl acetate was the same as in Example 1)

The above-described samples were evaluated as described in Example 1. It was found that the decrease in sensitivity due to the lapse of time before coating was small and the fastness of the color image was excellent.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one hydrophilic colloid layer containing at least one cyan dye forming coupler represented by the general formula (I) and at least one coupler solvent for the cyan dye forming coupler, the coupler solvent being represented by the general formulas (II) or (III)

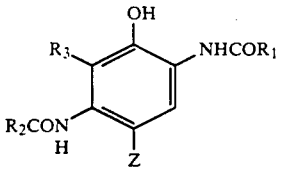

(I)

$L_1$+COOR$_4$)$_n$ (II)

wherein $R_1$ is a substituted or unsubstituted phenyl group;

$R_2$ and $R_3$ combine with each other to form a 5-membered, 6-membered, or 7-membered ring;

$R_4$ represents a substituted or unsubstituted aliphatic group, cyclic alkyl group or aromatic group;

Z represents a hydrogen atom or a group or atom which releases upon coupling with the oxidation product of an aromatic primary amine developing agent;

$L_1$ represents a divalent aliphatic group or a cyclic alkyl group; and n represents 2.

2. A silver halide photographic material as in claim 1, wherein a substituent for the aliphatic group, a cyclic alkyl group, aromatic group or heterocyclic group represented by $R_4$ is selected from an alkyl group, an aryl group, a heterocyclic group, an alkoxy group, an aryloxy group, an alkenyloxy group, an acyl group, an ester group, an amido group, a sulfamido group, an imido group, a ureido group, an aliphatic or aromatic sulfonyl group, an aliphatic or aromatic thio group, a hydroxy group, a cyano group, a carboxy group, a nitro group, a sulfo group, and a halogen atom, provided that $R_4$ is not substituted with a cyclic ether group.

3. A silver halide photographic material as claimed in claim 1, wherein the divalent aliphatic group represented by $L_1$ is an alkylidene group, an alkylene group or an alkenylene group.

4. A silver halide photographic material as in claim 1, wherein the group or atom which releases upon coupling represented by Z is a halogen atom, an alkoxy group, an aryloxy group, an acyloxy group, a sulfonyloxy group, an amido group, an alkoxycarbonyloxy group, an aryloxycarbonyloxy group, an aliphatic or aromatic thio group, an imido group or an aromatic azo group.

5. A silver halide photographic material as in claim 1, wherein Z is a hydrogen atom, a halogen atom, an alkoxy group or an aryloxy group.

6. A silver halide photographic material as in claim 1, wherein the total number of carbon atoms included in $R_4$ and $L_1$ is from 12 to 60.

7. A silver halide photographic material as in claim 1, wherein the hydrophilic colloid layer is a silver halide emulsion layer.

8. A silver halide photographic material as in claim 7, wherein the silver halide emulsion layer is a red-sensitive silver halide emulsion layer.

9. A silver halide photographic material as in claim 8, wherein the photographic material further comprises at least one green-sensitive silver halide emulsion layer containing a magenta coupler and at least one blue-sensitive silver halide emulsion layer containing a yellow coupler.

10. A silver halide photographic material as in claim 9, wherein the yellow coupler is a benzoylacetanilide or pivaloylacetanilide yellow coupler.

11. A silver halide photographic material as in claim 9, wherein the magenta coupler is a 3-arylamino-5-pyrazolone, 3-acylamino-5-pyrazolone or pyrazoloazole magenta coupler.

12. A silver halide photographic material as in claim 11, wherein the magenta coupler is represented by the general formula (M-1), (M-2) or (M-3):

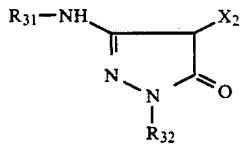

(M-1)

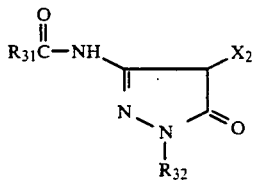

(M-2)

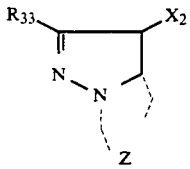

(M-3)

wherein $R_{31}$ represents a diffusion resistant group having from 8 to 32 carbon atoms; $R_{32}$ represents a phenyl group or a substituted phenyl group; $R_{33}$ represents a hydrogen atom or a substituent; Z represents a non-metallic atomic group necessary to form a 5-membered azole ring containing two to four nitrogen atoms wherein said azole ring may have one or more substituents (including a condensed ring); and $X_2$ represents a hydrogen atom or a releasable group.

13. A silver halide photographic material as claimed in claim 7, wherein the silver halide emulsion layer contains a monodispersed silver halide emulsion having a coefficient of variation not greater than 15%.

14. A silver halide photographic material as in claim 1, further comprising a cyan coupler represented by the following general formula (C-I) or (C-II):

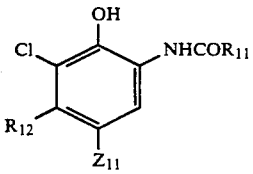

(C-I)

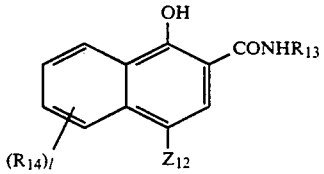

(C-II)

wherein $R_{11}$ and $R_{13}$ each represents an aliphatic group, a cyclic alkyl group, an aromatic group or a heterocyclic group; $R_{12}$ represents an alkyl group having from 1 to 20 carbon atoms; $R_{14}$ represents a substituent group on the naphthalene ring; $Z_{11}$ and $Z_{12}$ each represents a hydrogen atom or a group or atom which releases upon a coupling reaction with the oxidation product of a primary aromatic amine developing agent; and l represents an integer 0, 1 or 2.

15. A silver halide photographic material as in claim 14, wherein $R_{12}$ is an alkyl group having from 2 to 4 carbon atoms.

16. A silver halide photographic material as in claim 14, wherein $R_{14}$ is the group $R_{15}NH$- wherein $R_{15}$ represents an acyl group, a sulfonyl group, an aliphatic oxy group or an aromatic oxy group.

17. A silver halide photographic material as in claim 1, wherein the compound represented by the general formula (II) is used together with a high boiling organic solvent having a boiling point of about 160° C. or above at atmospheric pressure.

18. A silver halide photographic material as in claim 1, further comprising an ultraviolet light absorbing agent.

19. A silver halide photographic material as claimed in claim 18, wherein the ultraviolet light absorbing agent is represented by the following general formula (XI):

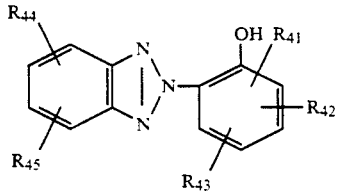

(XI)

wherein $R_{41}$, $R_{42}$, $R_{43}$, $R_{44}$, and $R_{45}$, which may be the same or different, each represents a hydrogen atom or a substituent as provided for the aliphatic group, cyclic alkyl group, or aromatic group represented by $R_1$ in the general formula (I), or $R_{44}$ and $R_{45}$ combine with each other to form a 5-membered or 6-membered aromatic ring composed of carbon atoms.

20. A silver halide photographic material as in claim 1, wherein the photographic material further comprises a hydroquinone color mixing preventing agent.

21. A silver halide photographic material as claimed in claim 20, wherein the color mixing preventing agent is represented by the general formula (XII):

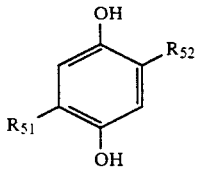

(XII)

wherein $R_{51}$ and $R_{52}$, which may be the same or different, each represents a hydrogen atom or a substituted or unsubstituted alkyl group with the proviso that at least one of $R_{51}$ and $R_{52}$ is an alkyl group.

22. A silver halide photographic material as in claim 20, wherein the color mixing preventing agent is represented by the general formula (XIII):

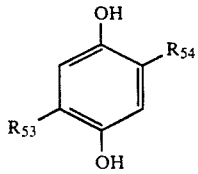

(XIII)

wherein $R_{53}$ represents a substituted or unsubstituted alkyl group, alkylthio group, amido group or alkoxy group; and $R_{54}$ represents a sulfo group or a sulfoalkyl group.

23. A silver halide photographic material as in claim 20, wherein the color mixing preventing agent is represented by the following general formula (XIV):

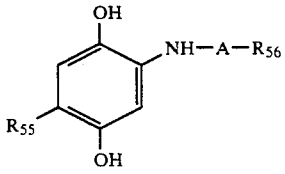

(XIV)

wherein $R_{55}$ represents a hydrogen atom, a halogen atom, or a substituted or unsubstituted alkyl group; A represents

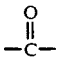

or $—SO_2—$; and $R_{56}$ represents a substituted or unsubstituted alkyl group or aryl group.

24. A silver halide photographic material as in claim 1, wherein the compound represented by the general formula (II) is employed in a range of from 0.1 to 10 parts by weight based on the quantity of cyan coupler represented by the general formula (I).

25. A silver halide photographic material as in claim 1, wherein the silver halide emulsion layer is formed by the steps which comprise:

(1) emulsifying and dispersing the cyan dye forming coupler of the general formula (I), the compound of the general formula (II) or (III) and a low-boiling organic solvent having a boiling point of from about 30° C. to about 160° C. in an aqueous solution, (2) removing the low-boiling organic solvent from the thus obtained emulsion and dispersion product, (3) mixing the emulsion and dispersion product and a silver halide emulsion, and then, (4) coting the mixed solution onto the support.

26. A silver halide photographic material as in claim 3, wherein $L_1$ is an alkenylene group.

27. A silver halide photographic material comprising a support having thereon at least one hydrophilic colloid layer containing at least one cyan dye forming coupler represented by the general formula (I) and at least one coupler solvent for the cyan dye forming coupler, the coupler solvent being represented by the general formulas (II) or (III):

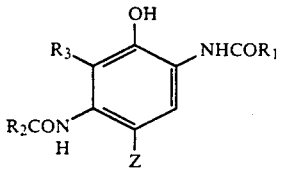

(I)

$L_1 \leftarrow COOR_4)_n$ (II)

wherein $R_1$ represents a substituted or unsubstituted aliphatic group, cyclic alkyl group, aromatic group, heterocyclic group, aromatic amino group or heterocyclic amino group;

$R_2$ and $R_3$ combine to form a 5-membered or 6-membered ring;

$R_4$ represents a substituted or unsubstituted aliphatic group, cyclic alkyl group or aromatic group;

Z represents a hydrogen atom or a group or atom which releases upon coupling with the oxidation product of an aromatic primary amine developing agent;

$L_1$ represents a divalent aliphatic group or a cyclic alkyl group; and n represents 2.

28. A silver halide photographic material as in claim 27, wherein $R_2$ and $R_3$ combine to form a 5-membered ring.

* * * * *